US011563284B2

(12) United States Patent
Oosaka

(10) Patent No.: US 11,563,284 B2
(45) Date of Patent: Jan. 24, 2023

(54) CONNECTOR ASSEMBLY AND CONNECTOR

(71) Applicant: Japan Aviation Electronics Industry, Limited, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/242,995

(22) Filed: Apr. 28, 2021

(65) Prior Publication Data

US 2021/0359441 A1 Nov. 18, 2021

(30) Foreign Application Priority Data

May 13, 2020 (JP) ..... JP2020-084468
May 26, 2020 (JP) ..... JP2020-091146
(Continued)

(51) Int. Cl.
*H01R 12/71* (2011.01)
*H01R 13/6473* (2011.01)
*H01R 13/627* (2006.01)

(52) U.S. Cl.
CPC ..... *H01R 12/716* (2013.01); *H01R 13/6271* (2013.01); *H01R 13/6473* (2013.01)

(58) Field of Classification Search
CPC ..... H01R 13/6583; H01R 12/716; H01R 13/6585; H01R 13/20; H01R 12/73; H01R 13/6582
See application file for complete search history.

(56) References Cited

U.S. PATENT DOCUMENTS 5,556,286 A * 9/1996 Ikesugi ..... H01R 12/716 439/31
5,876,217 A * 3/1999 Ito ..... H01R 13/20 439/74
(Continued)

FOREIGN PATENT DOCUMENTS

CN 203942060 U 11/2014
CN 109217031 A 1/2019
(Continued)

OTHER PUBLICATIONS

Taiwan Intellectual Property Office, "Office Action and Search Report for Taiwanese Patent Application No. 110108909," dated Feb. 9, 2022.
(Continued)

*Primary Examiner* — Abdullah A Riyami
*Assistant Examiner* — Nelson R. Burgos-Guntin
(74) *Attorney, Agent, or Firm* — Manabu Kanesaka

(57) ABSTRACT

Each of a first connector and a second connector of a connector assembly includes at least two high frequency signal terminals. When viewed from a first direction, each periphery of the high frequency signal terminals is surrounded by an outer shell and an inner shell. The outer shell has a substantially quadrilateral shape. The high frequency signal terminals, the outer shells surrounding peripheries of the high frequency signal terminals, and the inner shells, which are disposed on a second symmetry axis form a linearly symmetrical shape with the second symmetry axis as a center line of the outer shells along a second direction orthogonal to the first direction in which the high frequency signal terminals are arranged.

8 Claims, 21 Drawing Sheets

(30) Foreign Application Priority Data

Jun. 12, 2020 (JP) ..... JP2020-102280
Jun. 18, 2020 (JP) ..... JP2020-105098

(56) References Cited

U.S. PATENT DOCUMENTS 5,876,223 A 3/1999 Kaneshige et al.
5,885,093 A * 3/1999 Champion ..... H01R 12/716 439/101
5,888,077 A * 3/1999 Champion ..... H01R 12/7088 439/108
5,915,976 A * 6/1999 McHugh ..... H01R 13/6582 439/74
6,036,504 A * 3/2000 McHugh ..... H01R 12/7082 439/74
6,135,785 A * 10/2000 Niitsu ..... H01R 12/716 439/74
6,500,013 B1 * 12/2002 Wang ..... H01R 12/598 439/108
7,090,508 B1 * 8/2006 Chen ..... H01R 13/26 439/74
7,168,986 B1 * 1/2007 Peng ..... H01R 12/716 439/607.04
7,198,492 B2 * 4/2007 Shichida ..... H01R 24/50 439/74
D562,773 S * 2/2008 Peng ..... D13/147
D562,774 S * 2/2008 Kojima ..... D13/147
7,445,466 B1 * 11/2008 Peng ..... H01R 13/6271 439/570
7,494,346 B1 * 2/2009 Peng ..... H01R 12/716 439/74
7,494,347 B1 * 2/2009 Wang ..... H01R 12/716 439/74
7,494,378 B1 * 2/2009 Peng ..... H01R 13/6585 439/607.01
7,547,236 B1 * 6/2009 Chen ..... H01R 12/716 439/74
7,575,441 B1 * 8/2009 Huang ..... H01R 12/716 439/74
7,585,185 B2 * 9/2009 Obikane ..... H01R 12/716 439/74
7,591,669 B1 * 9/2009 Peng ..... H01R 12/716 439/910
7,604,500 B1 * 10/2009 Chen ..... H01R 12/707 439/570
7,748,994 B1 * 7/2010 Peng ..... H01R 13/6315 439/74
7,766,666 B1 * 8/2010 Chen ..... H01R 12/716 439/74
7,815,467 B2 * 10/2010 Tsuchida ..... H01R 12/716 439/607.09
8,292,630 B1 * 10/2012 Bobuk ..... H01R 12/73 439/74
8,840,407 B2 * 9/2014 Nose ..... H01R 12/716 439/74
8,968,005 B2 * 3/2015 Hirakawa ..... H02K 15/14 439/65
9,196,982 B2 * 11/2015 Sasaki ..... H01R 12/71
9,331,429 B2 * 5/2016 Choi ..... H01R 13/6335
9,425,526 B2 * 8/2016 Uratani ..... H01R 12/716
9,755,372 B2 * 9/2017 Ozeki ..... H01R 13/6591
10,084,265 B2 * 9/2018 Ozeki ..... H01R 13/631
10,312,637 B2 * 6/2019 Chuang ..... H01R 12/707
10,312,639 B2 * 6/2019 Chen ..... H01R 12/73
10,498,058 B1 * 12/2019 Kitazawa ..... H01R 13/6594
10,741,956 B2 * 8/2020 Matsuno ..... H01R 12/73
10,777,941 B2 * 9/2020 Horino ..... H01R 12/71
10,897,097 B2 * 1/2021 Hirakawa ..... H01R 13/115
2004/0058568 A1 * 3/2004 Ye ..... H01R 12/52 439/74
2004/0063344 A1 * 4/2004 Shin ..... H01R 13/26 439/74
2004/0142586 A1 * 7/2004 Yu ..... H01R 12/716 439/74
2004/0185690 A1 * 9/2004 Huang ..... H01R 13/26 439/74
2005/0009379 A1 * 1/2005 Huang ..... H01R 12/716 439/65
2006/0063432 A1 * 3/2006 Chen ..... H01R 13/658 439/607.36
2007/0173131 A1 * 7/2007 Chen ..... H01R 12/716 439/660
2007/0202729 A1 * 8/2007 Uesaka ..... H01R 13/41 439/248
2007/0281519 A1 * 12/2007 Shiroyama ..... H01R 13/20 439/108
2008/0038939 A1 * 2/2008 Wu ..... H01R 12/52 439/55
2008/0139019 A1 * 6/2008 Shiu ..... H01R 12/716 439/83
2008/0207014 A1 * 8/2008 Takeuchi ..... H01R 12/716 439/74
2009/0305528 A1 * 12/2009 Hirata ..... H01R 12/716 439/74
2009/0318029 A1 * 12/2009 Takeuchi ..... H01R 13/432 439/630
2010/0048041 A1 * 2/2010 Lei ..... H01R 13/20 439/74
2010/0151702 A1 * 6/2010 Chen ..... H01R 12/707 439/65
2010/0159717 A1 * 6/2010 Takeuchi ..... H01R 13/20 439/65
2010/0291776 A1 * 11/2010 Huang ..... H01R 13/2457 439/74
2010/0311256 A1 * 12/2010 Chen ..... H01R 13/41 439/81
2010/0330821 A1 * 12/2010 Takeuchi ..... H01R 12/716 439/65
2011/0014800 A1 * 1/2011 Cheng ..... H01R 12/716 439/55
2011/0045679 A1 * 2/2011 Yu ..... H01R 12/716 439/74
2011/0165797 A1 * 7/2011 Takeuchi ..... H01R 12/716 439/660
2011/0201226 A1 * 8/2011 Suzuki ..... H01R 12/716 439/374
2011/0201227 A1 * 8/2011 Takeuchi ..... H01R 12/716 439/374
2012/0094544 A1 * 4/2012 Sato ..... H01R 13/11 439/660
2012/0231637 A1 * 9/2012 Takeuchi ..... H01R 12/716 439/65
2013/0012039 A1 * 1/2013 Nose ..... H01R 12/716 439/74
2013/0065460 A1 * 3/2013 Hirata ..... H01R 12/716 439/884
2013/0130555 A1 * 5/2013 Hirata ..... H01R 12/716 439/626
2013/0137304 A1 * 5/2013 Huang ..... H01R 12/716 439/626
2013/0137306 A1 * 5/2013 Huang ..... H01R 24/60 439/660
2013/0137307 A1 * 5/2013 Huang ..... H01R 24/60 439/660
2013/0178076 A1 * 7/2013 Huang ..... H01R 12/73 439/65
2013/0210270 A1 * 8/2013 Takeuchi ..... H01R 12/716 439/488
2013/0260587 A1 * 10/2013 Chen ..... H01R 24/84 439/284
2013/0260589 A1 * 10/2013 Chen ..... H01R 24/84 439/284
2013/0260594 A1 * 10/2013 Lee ..... H01R 13/639 439/345
2013/0280926 A1 * 10/2013 Ono ..... H01R 12/7052 439/65
2013/0309895 A1 * 11/2013 Nishimura ..... H01R 12/73 439/345

(56) References Cited

U.S. PATENT DOCUMENTS

2013/0330943 A1* 12/2013 Sasaki ..... H01R 12/716 439/74
2013/0330970 A1* 12/2013 Hirata ..... H01R 12/716 439/620.01
2014/0220830 A1* 8/2014 Kubo ..... H01R 13/10 439/660
2014/0273587 A1* 9/2014 Takenaga ..... H01R 13/20 439/345
2014/0322941 A1* 10/2014 Lee ..... H01R 12/88 439/153
2015/0079816 A1* 3/2015 Suzuki ..... H01R 13/6275 439/74
2015/0079853 A1* 3/2015 Tsai ..... H01R 12/73 439/751
2015/0132985 A1* 5/2015 Choi ..... H01R 13/6335 439/345
2015/0140840 A1* 5/2015 Nishimura ..... H01R 12/775 439/74
2015/0194753 A1* 7/2015 Raff ..... H01R 12/716 29/830
2015/0200477 A1* 7/2015 Kim ..... H05K 1/144 439/378
2015/0207248 A1* 7/2015 Takenaga ..... H01R 12/716 439/74
2015/0263464 A1* 9/2015 Arichika ..... H01R 13/6275 439/374
2015/0303597 A1* 10/2015 He ..... H01R 12/7088 439/345
2015/0311610 A1* 10/2015 Little ..... H01R 12/707 439/284
2015/0357729 A1* 12/2015 Uratani ..... H01R 12/716 439/585
2015/0380845 A1* 12/2015 Goto ..... H01R 12/73 439/660
2016/0056557 A1* 2/2016 Chen ..... H01R 12/716 439/660
2016/0093967 A1* 3/2016 Takenaga ..... H01R 12/716 439/660
2016/0179733 A1* 6/2016 Huang ..... G06F 13/4282 710/308
2016/0294082 A1* 10/2016 Matsuno ..... H01R 12/7005
2016/0315430 A1* 10/2016 Takeuchi ..... H01R 12/707
2017/0005423 A1* 1/2017 Takenaga ..... H01R 13/635
2017/0033510 A1* 2/2017 Ozeki ..... H01R 43/205
2017/0070014 A1* 3/2017 Kodaira ..... H01R 24/60
2018/0175561 A1* 6/2018 Chen ..... H01R 12/52
2018/0183189 A1* 6/2018 Chuang ..... H01R 13/41
2018/0198241 A1* 7/2018 Ooi ..... H01R 13/6585
2019/0097360 A1* 3/2019 Chen ..... H01R 13/6594
2019/0296489 A1* 9/2019 Nishi ..... H01R 13/631
2020/0161816 A1* 5/2020 Amemori ..... H01R 13/631
2021/0098943 A1* 4/2021 Hayashi ..... H01R 13/6587
2021/0167555 A1* 6/2021 Oosaka ..... H01R 13/6581
2021/0175649 A1 6/2021 Amemori et al.
2021/0175666 A1* 6/2021 Zhang ..... H01R 12/716
2021/0218194 A1* 7/2021 Shimomura ..... H01R 13/6581
2021/0218196 A1* 7/2021 Shimomura ..... H01R 13/6585
2021/0242617 A1 8/2021 Ji et al.
2021/0359437 A1* 11/2021 Oosaka ..... H01R 13/502
2021/0359440 A1* 11/2021 Oosaka ..... H01R 12/73
2021/0359456 A1* 11/2021 Oosaka ..... H01R 13/506
2021/0359458 A1* 11/2021 Oosaka ..... H01R 13/6582
2021/0359459 A1* 11/2021 Oosaka ..... H01R 13/6581
2021/0359460 A1* 11/2021 Oosaka ..... H01R 13/502
2021/0359463 A1* 11/2021 Oosaka ..... H01R 13/6582
2021/0359469 A1* 11/2021 Oosaka ..... H01R 12/716
2021/0359471 A1* 11/2021 Oosaka ..... H01R 12/716
2021/0359473 A1* 11/2021 Oosaka ..... H01R 13/6585
2021/0359474 A1* 11/2021 Oosaka ..... H01R 13/6471
2021/0391669 A1* 12/2021 Okubo ..... H01R 13/641
2022/0052470 A1* 2/2022 Hosoda ..... H01R 43/16
2022/0094110 A1* 3/2022 Okubo ..... H01R 12/73
2022/0140512 A1* 5/2022 Amemori ..... H01R 13/6581 439/259

FOREIGN PATENT DOCUMENTS

JP 2019-121439 A 7/2019
JP 6638873 B1 1/2020
KR 10-0231119 B1 11/1999

OTHER PUBLICATIONS

Korean Intellectual Property Office, "Office Action for Korean Patent Application 10-2021-0023171," dated Jul. 20, 2022.
Taiwan Intellectual Property Office, "Office Action for Taiwanese Patent Application No. 110108909," dated Aug. 29, 2022.

* cited by examiner prior art

CONNECTOR ASSEMBLY AND CONNECTOR

RELATED APPLICATIONS

The present application is based on, and claims priorities from, Japanese Patent Applications No. 2020-084468 filed May 13, 2020; No. 2020-091146 filed May 26, 2020; No. 2020-102280 filed Jun. 12, 2020; and No. 2020-105098 filed Jun. 18, 2020, the disclosure of which is hereby incorporated by reference herein in its entirety.

BACKGROUND OF THE INVENTION

Field of the Invention

The present invention relates to a connector assembly and a connector.

Description of the Related Art

Conventionally, a board-to-board connector for electrically connecting two flat circuit boards has been known. The connector of this type includes a plurality of signal terminals for transmission of signals such as high frequency signals. As these signal terminals are required to exhibit good signal transmission characteristics, it is necessary to stabilize each impedance of the signal terminals.

For example, referring to FIG. 21, JPA2019-121439 (Patent Document 1) discloses a connector in which a connector housing 11 is provided with terminals each having a contact surface corresponding to counter terminals at intervals. The connector includes a plurality of signal terminals 12, 13 14 (a plurality of high frequency signal terminals) which are arranged in a row while having ground terminals 15, 16 (inner shells) interposed between the signal terminals. The ground terminals 15, 16 (inner shells) are constituted by conductive plates having plate surfaces 15a, 16a intersecting the array direction of the signal terminals 12, 13, 14 (high frequency signal terminals).

The connector disclosed in Patent Document 1 as described above has a quasi-coaxial structure in which the respective high frequency signal terminals (signal terminals 12, 13, 14) are surrounded by the outer shell (shell-like conductor 17) and the inner shells (ground terminals 15, 16) for impedance matching to improve transmission characteristics.

The connector disclosed in Patent Document 1, however, has the problem that transmission characteristics differ unless all wirings on the substrate connected to the high frequency signal terminals are wired orthogonally to the center line of the outer shell along the array direction of the high frequency signal terminals, and arranged in the same direction.

It is an object of the present invention to provide a connector assembly and a connector which ensure that transmission characteristics remain unchanged even if lead-out directions of all wirings extending orthogonally to the center line of the outer shell on the substrate connected to the high frequency signal terminals are not the same.

SUMMARY OF THE INVENTION

A connector assembly according to an aspect of the present invention includes a first connector and a second connector, the first connector being mateable with and removable from the second connector along a first direction.

Each of the first connector and the second connector includes at least two high frequency signal terminals. When viewed from the first direction, each periphery of the high frequency signal terminals is surrounded by an outer shell and an inner shell. The outer shell has a substantially quadrilateral shape. The high frequency signal terminals, the outer shells surrounding peripheries of the high frequency signal terminals, and the inner shells, which are disposed on a second symmetry axis form a linearly symmetrical shape with the second symmetry axis as a center line of the outer shells along a second direction orthogonal to the first direction in which the high frequency signal terminals are arranged. In a sectional view of each of the high frequency signal terminals along the first direction when viewed from the second direction, the high frequency signal terminals form a linearly symmetrical shape with a first symmetry axis as a center line of the high frequency signal terminals in the first direction orthogonal to the second symmetry axis.

That is, the connector assembly according to the present invention has the linearly symmetrical quasi-coaxial structure for impedance matching, constituted by the high frequency signal terminals, and the outer shell and the inner shell for surrounding the terminals and peripheries thereof. In the condition that wirings on the substrate connected to the high frequency signal terminals extend orthogonally to the center line (second symmetry axis) of the outer shell, the configuration of the transmission line is kept unchanged even if lead-out directions of all the wirings on the substrate are not the same. In the connector assembly according to the present invention, the high frequency signal terminals form a symmetrical structure. In the condition that the wirings on the substrate connected to the high frequency signal terminals extend orthogonally to the center line (second symmetry axis) of the outer shell, the impedance characteristics hardly differs even if the lead-out directions of all the wirings on the substrate are not the same.

The connector assembly according to the present invention is formed as the board-to-board connector for electrically connecting a first circuit board on which the first connector is mounted, and a second circuit board on which the second connector is mounted.

The connector of the present invention is usable as the first connector.

The connector of the present invention is usable as the second connector.

The connector assembly according to another aspect of the present invention includes a first connector and a second connector, the first connector being mateable with and removable from the second connector along a first direction. Each of the first connector and the second connector includes an outer shell and at least two high frequency signal terminals. The high frequency signal terminals and the outer shells adjacently disposed to the high frequency signal terminals form a quasi-stripline structure when viewed from the first direction. The high frequency signal terminals and the adjacently disposed outer shells on a second symmetry axis form the quasi-stripline structure having a linearly symmetrical shape with the second symmetry axis as a center line of the outer shells along a direction orthogonal to the first direction in which the high frequency signal terminals are arranged.

The connector assembly according to the present invention has the linearly symmetrical quasi-stripline structure for impedance matching, constituted by the high frequency signal terminals and the adjacently disposed outer shells. In the condition that wirings on the substrate connected to the high frequency signal terminals orthogonally extend to the center line (second symmetry axis) of the outer shell, the configuration of the transmission line is kept unchanged even if the lead-out directions of all the wirings on the substrate are not the same.

In the connector assembly and the connector according to the present invention, in the condition that the wirings on the substrate connected to the high frequency signal terminals extend orthogonally to the center line of the outer shell, configuration of the transmission line for impedance matching is kept unchanged even if the lead-out directions of all the wirings on the substrate are not the same, thereby ensuring that the transmission characteristics remain unchanged even if all the wirings are not in the same direction.

DETAILED DESCRIPTION OF THE PREFERRED EMBODIMENTS

Figure 1:
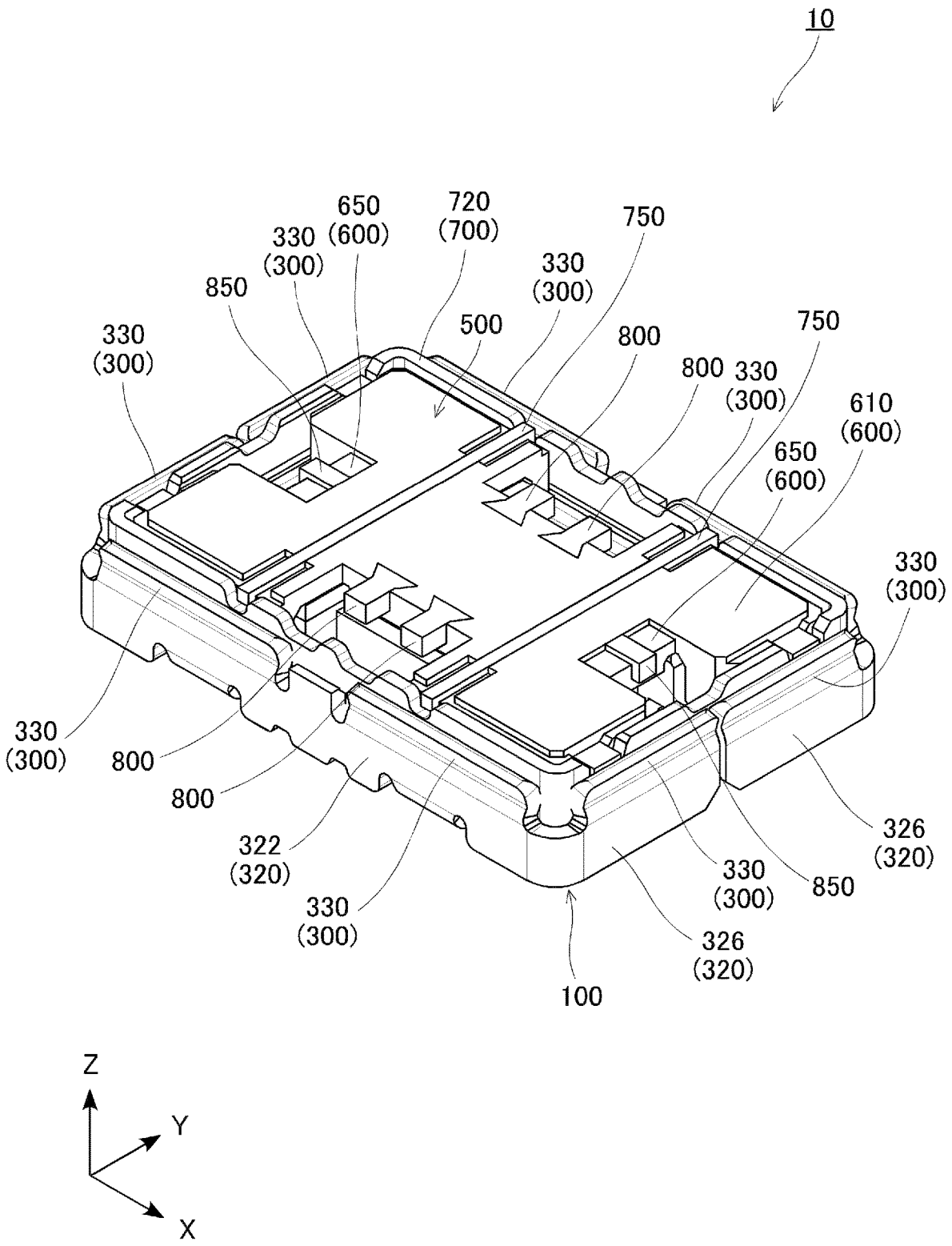
FIG. 1 is an upper perspective view of a connector assembly according to an embodiment.
Figure 2:
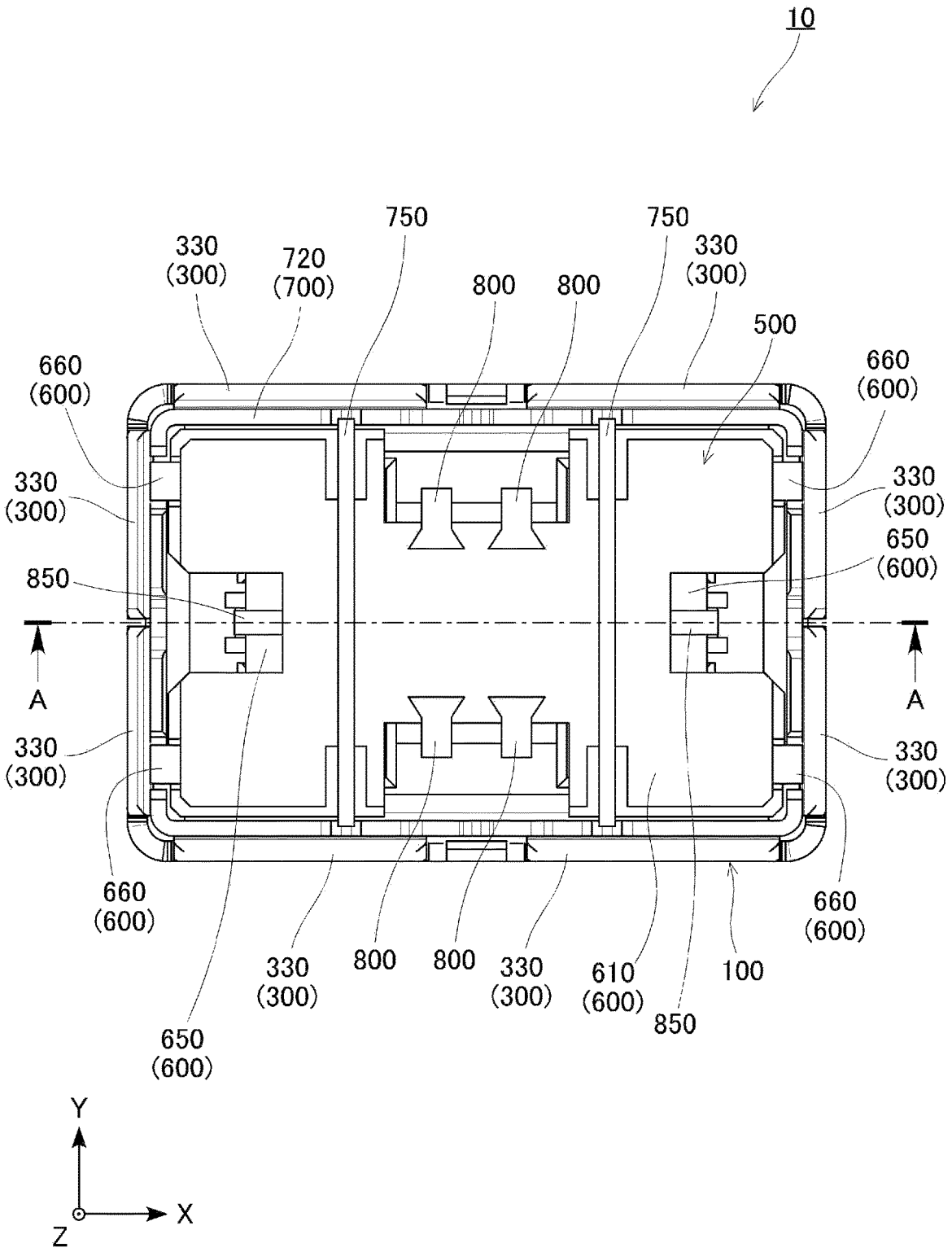
FIG. 2 is a top view of the connector assembly of FIG. 1.

A preferred embodiment of the present invention will be described referring to the drawings. The embodiment is not intended to limit the present invention as claimed, and all possible combinations of characteristics as described in the embodiment are not necessarily essential for solution to be provided by the present invention.

As FIG. 1 illustrates, a connector assembly 10 of this embodiment includes a first connector 500 and a second connector 100.

Figure 4:
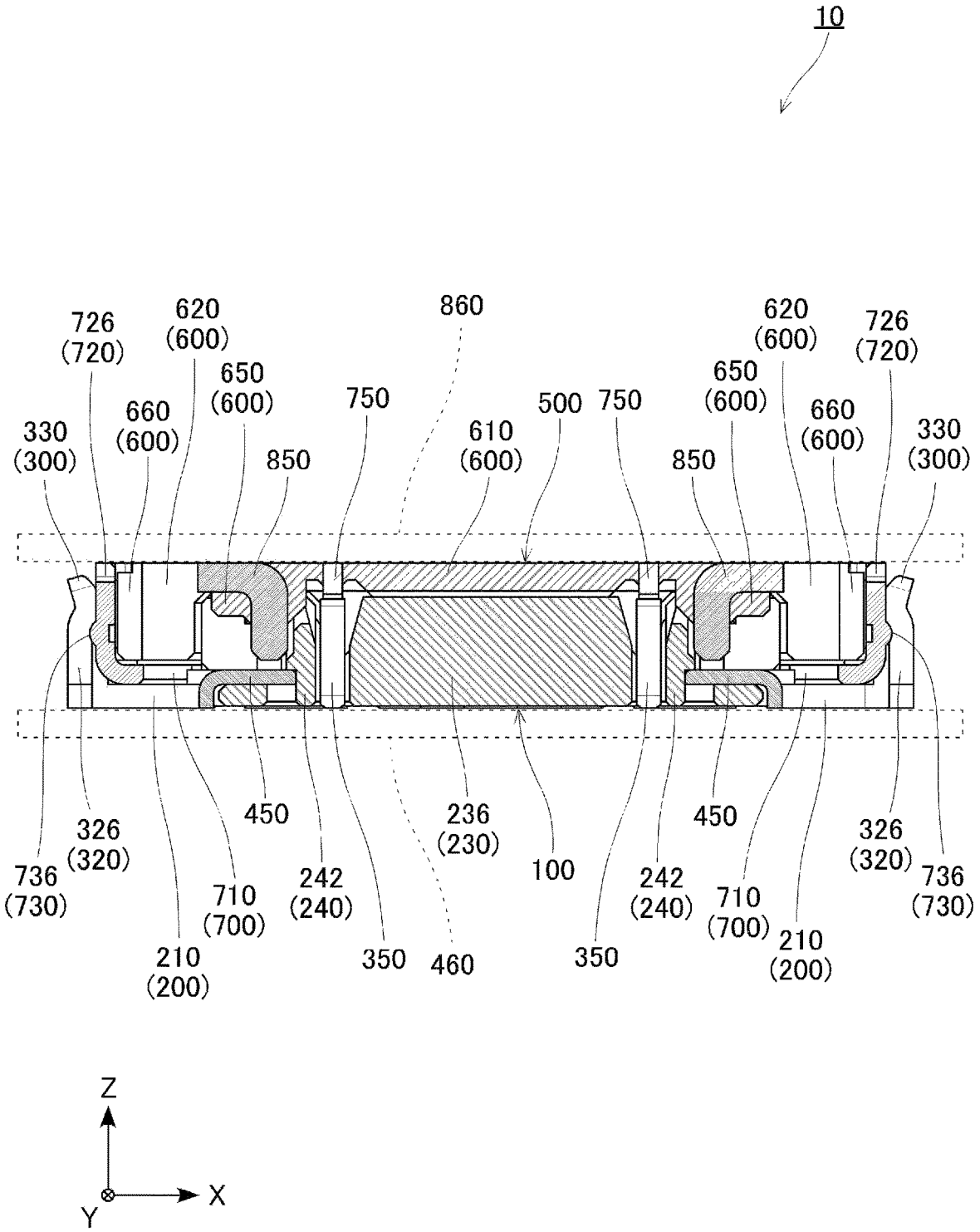
FIG. 4 is a sectional view of the connector assembly, taken along line A-A of FIG. 2, having first and second circuit boards indicated by dashed lines.
Figure 5:
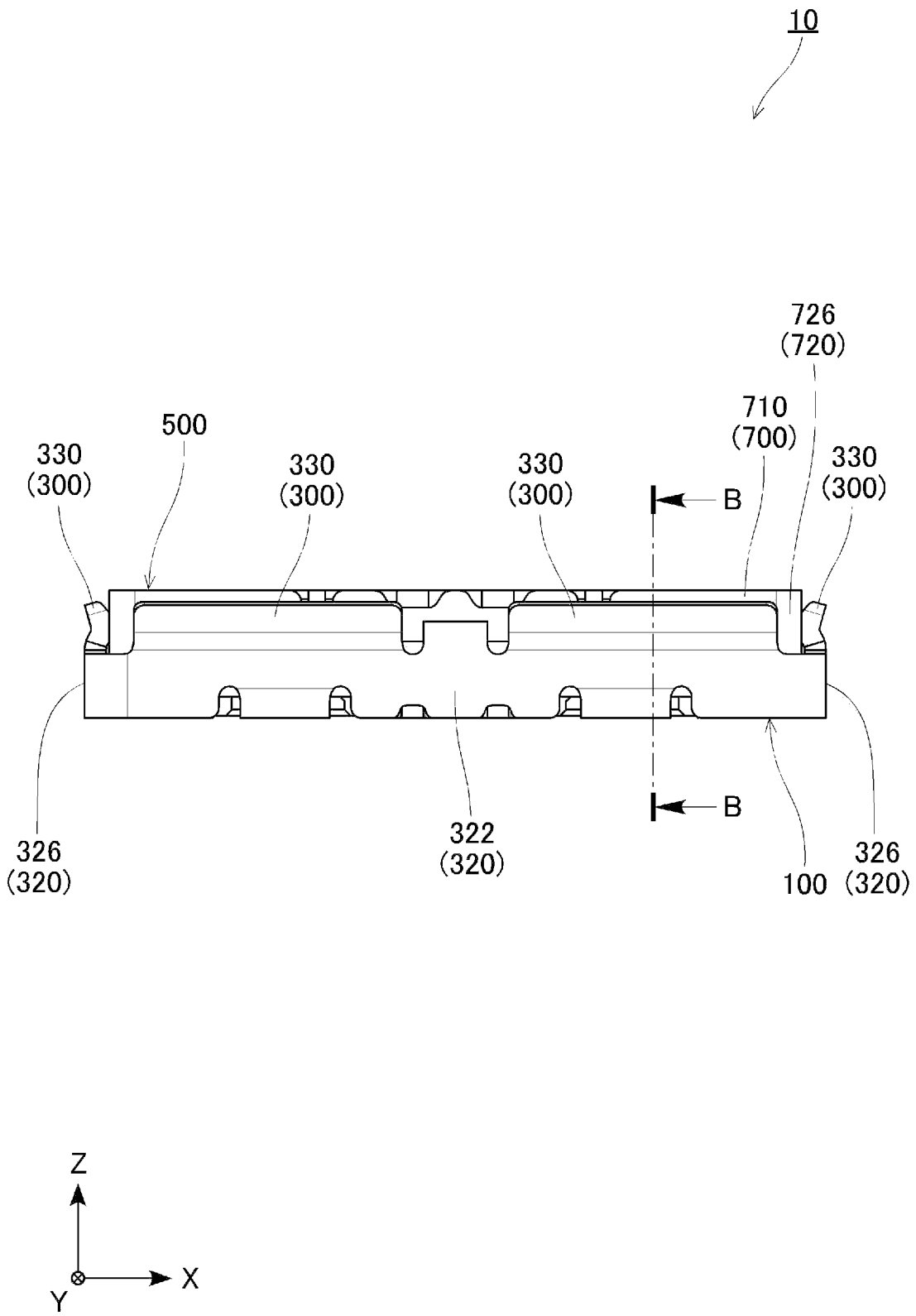
FIG. 5 is a front view of the connector assembly of FIG. 1.

Referring to FIG. 1 and FIG. 4, the first connector 500 of the embodiment is mateable with and removable from the second connector 100 along a first direction. In the embodiment, the first direction corresponds to an up-down direction or Z direction in the drawing. Specifically, a positive Z direction corresponds to the upward direction, and a negative Z direction corresponds to the downward direction.

Referring to FIG. 4, FIG. 6, FIG. 10 and FIG. 12, the first connector 500 of the embodiment is fixed to a first circuit board 860.

Figure 8:
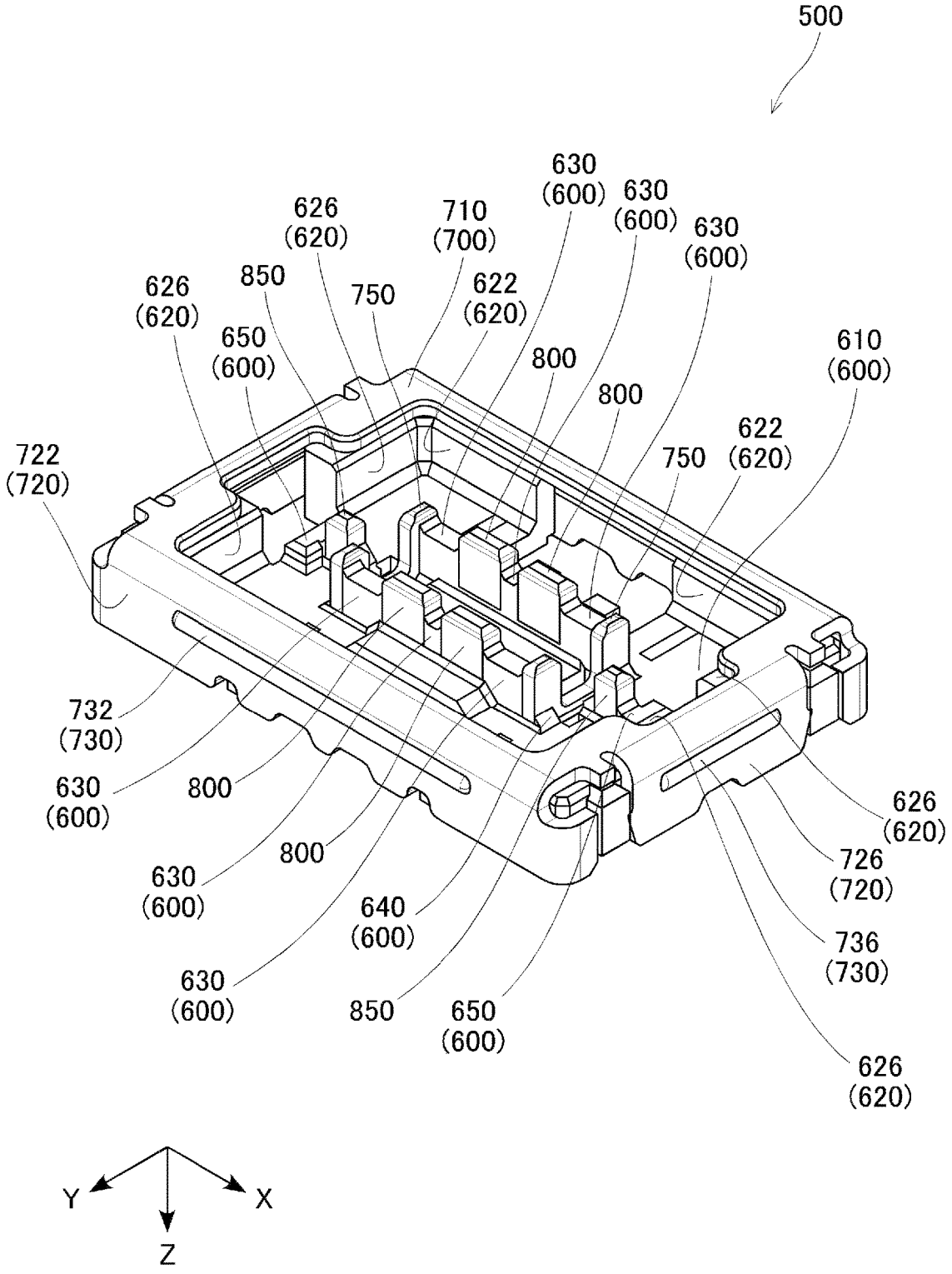
FIG. 8 is a lower perspective view of a first connector of the connector assembly as illustrated in FIG. 1.
Figure 9:
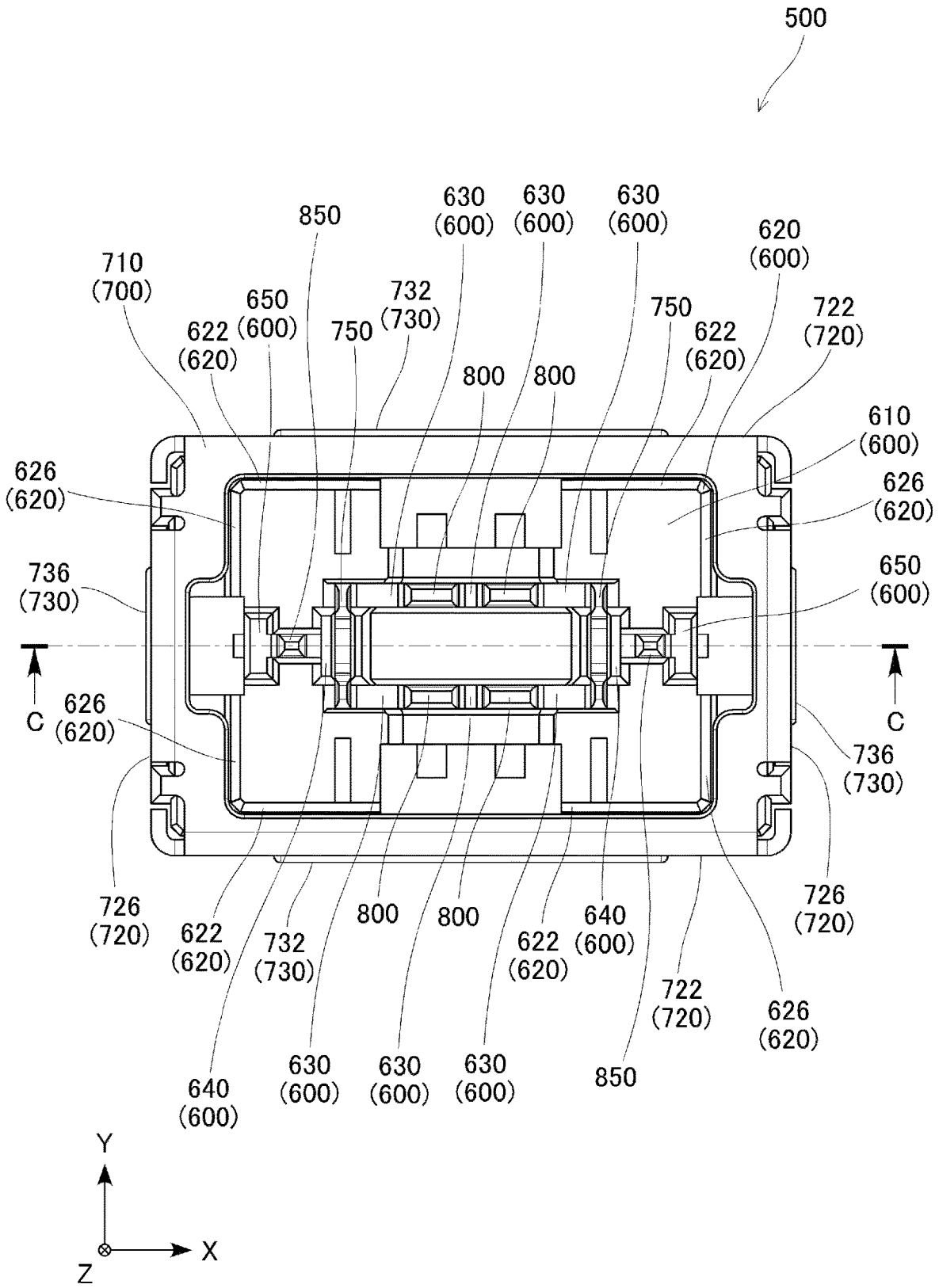
FIG. 9 is a bottom view of the first connector of FIG. 8.

Referring to FIG. 8 and FIG. 9, the first connector 500 of the embodiment includes a first insulator 600, a first outer shell 700 for surrounding the first insulator 600, two first inner shells 750 attached to the inside of the first insulator 600, a plurality of first electric terminals 800 positioned between the two first inner shells 750, and two first high frequency signal terminals 850 each disposed in a region interposed between the first outer shell 700 and the first inner shell 750. The scope of the present invention is not limited to the embodiment. In the present invention, the number of the first electric terminals 800 may be at least one without being limited to the number as described in the embodiment. The first connector 500 may be constituted by the first insulator 600, the first outer shell 700, the first inner shells 750, and the first high frequency signal terminals 850. That is, the first connector 500 does not have to include the first electric terminals 800.

Figure 12:
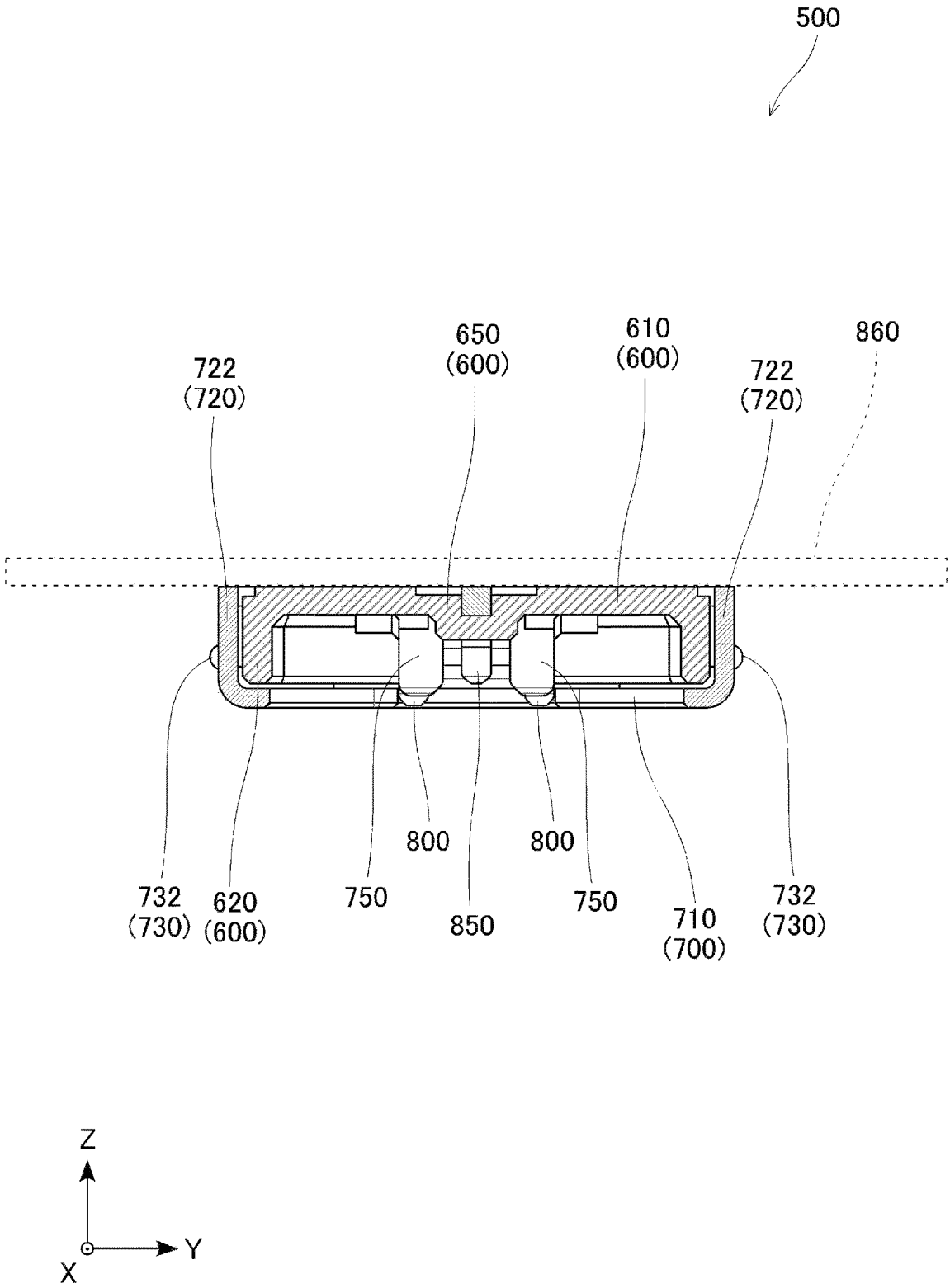
FIG. 12 is a sectional view of the first connector taken along line D-D of FIG. 11, having the first circuit board indicated by a dashed line.

Referring to FIG. 8, FIG. 9 and FIG. 12, the first insulator 600 of the embodiment made of resin includes an upper surface portion 610, a first peripheral portion 620, a first electric terminal housing 630, a first inner shell housing 640, a first high frequency signal terminal housing 650, and a first outer shell fixing portion 660.

Figure 10:
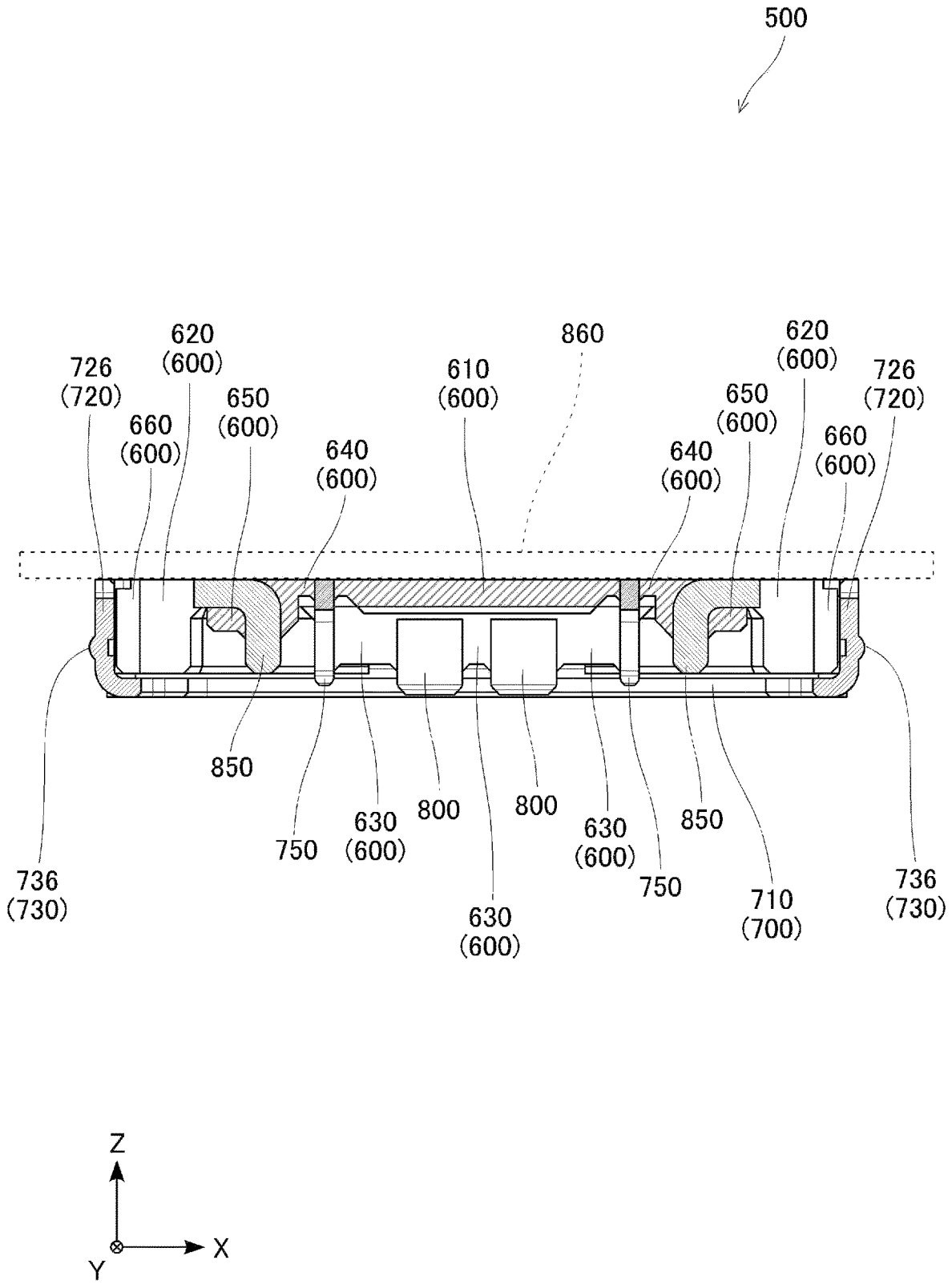
FIG. 10 is a sectional view of the first connector taken along line C-C of FIG. 9, having the first circuit board indicated by a dashed line.
Figure 11:
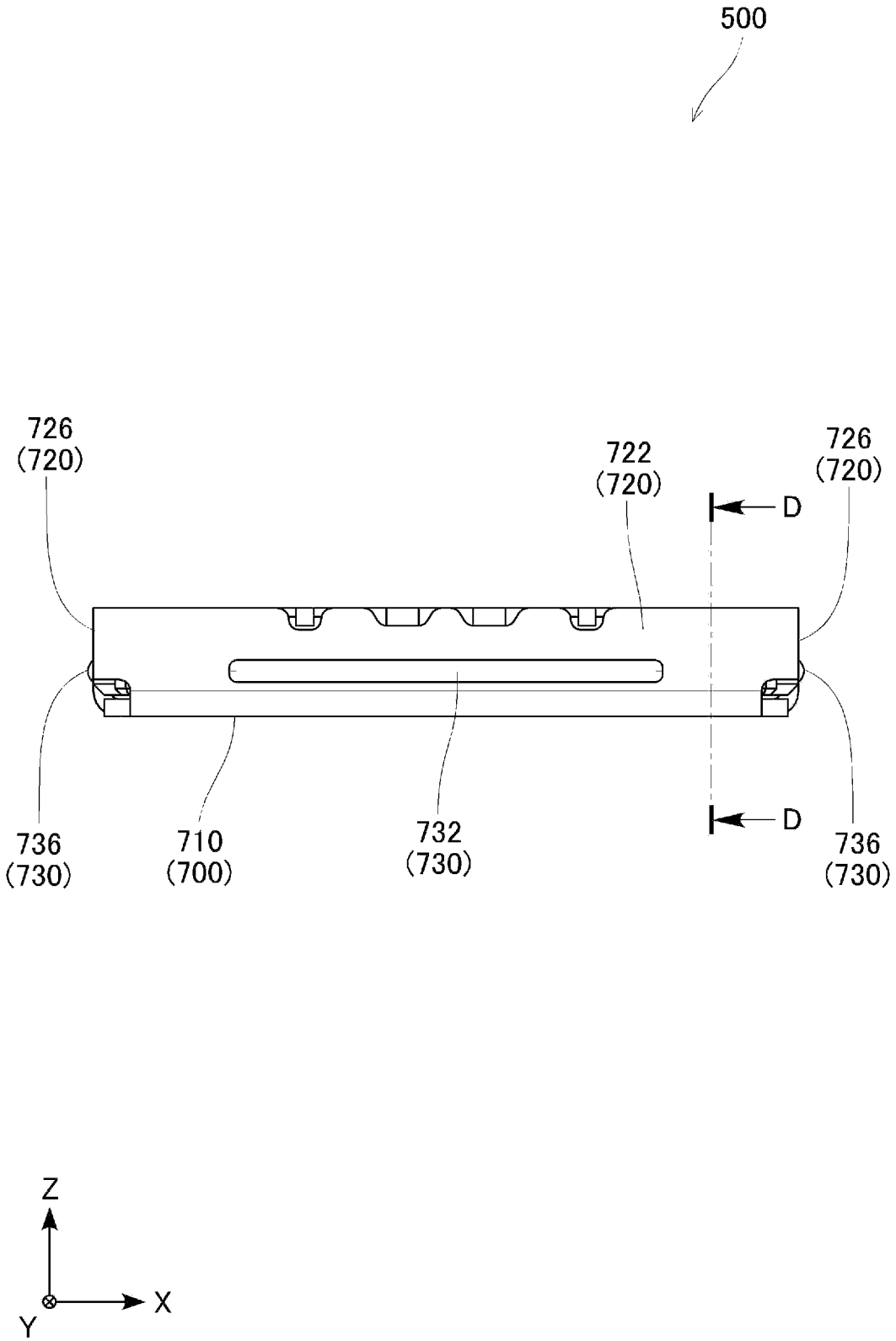
FIG. 11 is a front view of the first connector of FIG. 8, having the first circuit board indicated by a dashed line.

As FIG. 9, FIG. 10 and FIG. 12 illustrate, the upper surface portion 610 of the embodiment has a rectangular flat plate shape orthogonal to the up-down direction, and defines an upper end of the first insulator 600.

As FIG. 8 and FIG. 9 illustrate, the first peripheral portion 620 of the embodiment has an outer periphery in which each center part of four sides constituting the rectangular shape is cut when viewed along the up-down direction. The first peripheral portion 620 includes four first longer walls 622 and four first shorter walls 626.

As FIG. 8 and FIG. 12 illustrate, two of the four first longer walls 622 of the embodiment are arranged along a second direction, and two pairs of the first longer walls 622 face with each other with respect to a third direction. In the embodiment, the second direction corresponds to a direction X, and the third direction corresponds to a direction Y. Each upper end of the first longer walls 622 is connected to the upper surface portion 610.

As FIG. 8 and FIG. 12 illustrate, two of the four first shorter walls 626 of the embodiment are arranged along the third direction, and two pairs of the first shorter walls 626 face with each other with respect to the second direction. Each upper end of the first shorter walls 626 is connected to the upper surface portion 610. Ends of the first shorter walls 626 in the second direction are connected to the first longer walls 622, respectively. Lower ends of the first shorter walls 626 in the up-down direction are at the same level as those of the first longer walls 622. That is, the first peripheral portion 620 has an outer shape including L-like sections at four corners of the rectangular flat plate-like first insulator 600.

As FIG. 8, FIG. 9 and FIG. 10 illustrate, the first electric terminal housing 630 of the embodiment has two wall surfaces extending along the second direction in the parallel arrangement in the third direction. The wall surface has recess portions each with an open lower end in the up-down direction. In the embodiment, the four first electric terminals 800 are provided, and two recess portions are formed in each of the two wall surfaces in parallel arrangement in the third direction. That is, the recess portions of the first electric terminal housing 630 define the respective positions of the first electric terminals 800. The first electric terminal housing 630 is surrounded by the first peripheral portion 620 in the plane orthogonal to the up-down direction. In the embodiment, the XY plane is orthogonal to the up-down direction.

As FIG. 8, FIG. 9 and FIG. 10 illustrate, the first inner shell housings 640 of the embodiment are holes formed in the respective ends of the two wall surfaces in parallel arrangement for constituting the first electric terminal housing 630. The first inner shell 750 to be described later is a plate-like metal member, and disposed to have the plate surface aligned along the third direction. In other words, the holes are formed as the first inner shell housings 640 so that the plate surfaces of the first inner shells 750 are disposed parallel to each other in the third direction orthogonal to the second direction as the direction of the wall surfaces of the first electric terminal housing 630 having two parallel wall surfaces.

As FIG. 8, FIG. 9 and FIG. 10 illustrate, the first high frequency signal terminal housings 650 of the embodiment are holes for storing and fixing the first high frequency signal terminals 850. Each of the two first high frequency terminals 850 is disposed in a region between the first outer shell 700 and the first inner shell 750. The first high frequency signal terminal housings 650 are holes which are formed at positions corresponding to the two mount positions, respectively.

As FIG. 8 and FIG. 9 illustrate, the first outer shell fixing portions 660 of the embodiment are protruding portions each protruding outward from the side surface of the upper surface portion 610 of the first insulator 600 in the second direction. The two first outer shell fixing portions 660 are formed on the side surface in the positive X direction, and the two first outer shell fixing portions 660 are formed on the side surface in the negative X direction. The two first outer shell fixing portions 660 as protruding portions on the respective side surfaces grip a part of the first outer shell 700 to be described later. Then the first outer shell 700 is fixed to the first insulator 600 using elastic force of the first outer shell 700 as the metal member.

As FIG. 8 to FIG. 10, and FIG. 12 illustrate, the first outer shell 700 of the embodiment is held by the first insulator 600. More specifically, the first outer shell 700 comes in contact with the lower end of the first peripheral portion 620 of the first insulator 600, and fixedly held by the respective two protruding portions protruding from the two side surfaces, that is, four protruding portions in total in the second direction of the upper surface portion 610 of the first insulator 600.

Referring to FIG. 8 and FIG. 9, the first outer shell 700 of the embodiment has a substantially quadrilateral outer shape when viewed from the first direction. The first outer shell 700 made of metal includes a first metal plane 710, a first metal peripheral portion 720, and a first metal engaging portion 730.

As FIG. 9 to FIG. 12 illustrate, the first metal plane 710 of the embodiment is orthogonal to the first direction, that is, the up-down direction. The first metal plane 710 is positioned at the lower end of the first longer wall 622 of the first peripheral portion 620 of the first insulator 600. The first metal plane 710 is positioned at the lower end of the first shorter wall 626 of the first peripheral portion 620 of the first insulator 600.

As FIG. 8 illustrates, the first metal peripheral portion 720 of the embodiment includes first longer metal walls 722 and first shorter metal walls 726.

As FIG. 8 indicates, the first longer metal wall 722 of the embodiment has a flat plate-like shape orthogonal to the first direction. The first longer metal walls 722 are positioned at the respective outer ends of the two first longer walls 622 of the first peripheral portion 620 of the first insulator 600 in the third direction.

As FIG. 8 indicates, the first shorter metal wall 726 of the embodiment has a flat plate-like shape orthogonal to the first direction. The first shorter metal walls 726 are positioned at the respective outer ends of the two first shorter walls 626 of the first peripheral portion 620 of the first insulator 600 in the second direction.

The first shorter metal wall 726 of the embodiment has its side surface in the third direction gripped by the first outer shell fixing portion 660 protruding outward from the side surface of the upper surface portion 610 of the first insulator 600 in the second direction. More specifically, as FIG. 8 illustrates, the two first outer shell fixing portions 660 as the protruding portions are formed on both side surfaces of the first insulator 600 in the X direction. The first shorter metal wall 726 is inserted to be gripped between the two protruding portions. Difference between the interval dimension of the first outer shell fixing portions 660 as two protruding portions and the width dimension of the first shorter metal wall 726 in the third direction generates bending force in the first shorter metal wall 726. The first shorter metal wall 726 as the metal member generates the elastic force against the bending force so that the first shorter metal wall 726 is fixed between the two first outer shell fixing portions 660.

Referring to FIG. 10 and FIG. 12, each upper end of the first longer metal walls 722 and the first shorter metal walls 726 of the first metal peripheral portion 720 of the embodiment is soldered to a circuit pattern (not shown) on the first circuit board 860 when fixing the first connector 500 to the first circuit board 860. This allows the first outer shell 700 to have a ground potential as a ground conductor.

As FIG. 8 illustrates, the first metal engaging portion 730 of the embodiment includes a first longer metal engaging portion 732 and a first shorter metal engaging portion 736.

As FIG. 8 illustrates, the first longer metal engaging portion 732 of the embodiment is a bar-like protruding portion formed on the wall surface of the first longer metal wall 722 as an outer peripheral surface thereof in the third direction. The first longer metal engaging portion 732 of the embodiment is positioned at the center of the outer peripheral surface of the first longer metal wall 722 with respect to the third direction. The first longer metal engaging portion 732 as the bar-like protruding portion is formed while extending along the second direction.

As FIG. 8 illustrates, the first shorter metal engaging portion 736 of the embodiment is a bar-like protruding portion formed on the wall surface as an outer peripheral surface of the first shorter metal wall 726 in the second direction. The first shorter metal engaging portion 736 of the embodiment is positioned at the center of the outer peripheral surface of the first shorter metal wall 726 in the second direction. The first shorter metal engaging portion 736 as the bar-like protruding portion is formed while extending along the third direction.

Figure 6:
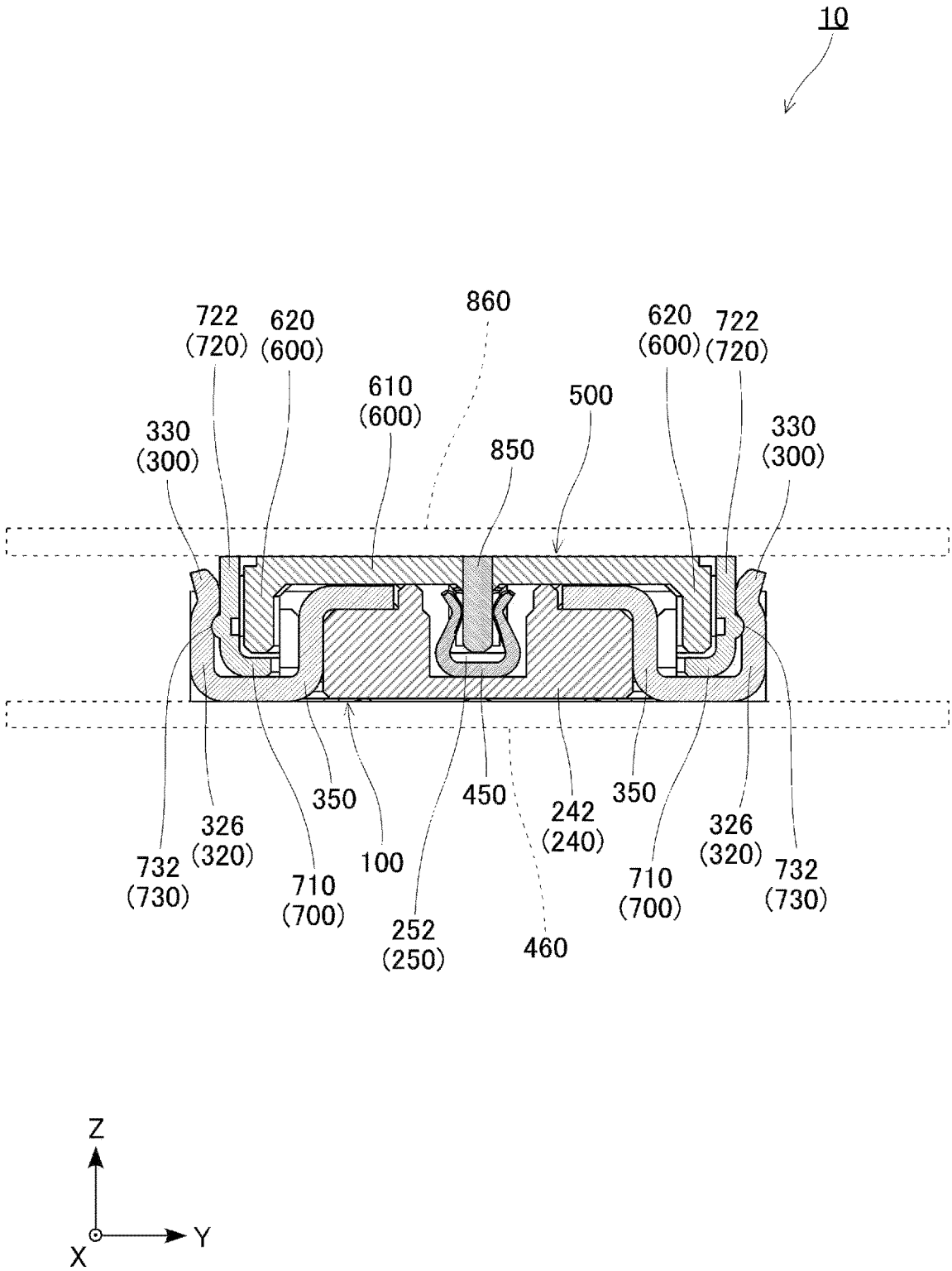
FIG. 6 is a sectional view of the connector assembly taken along line B-B of FIG. 5, having the first and the second circuit boards indicated by dashed lines.

As FIG. 4 and FIG. 6 indicate, the first longer metal engaging portion 732 and the first shorter metal engaging portion 736 come in contact with an outer shell of the second connector 100 (to be described later in detail) to receive the force so that the first longer metal wall 722 and the first shorter metal wall 726 incline toward the center of the first outer shell 700. The inclining force generates the elastic force in the first longer metal wall 722 and the first shorter metal wall 726 of the first outer shell 700 as the metal member. The generated elastic force is applied to the outer shell (to be described later in detail) of the second connector 100 via the first longer metal engaging portion 732 and the first shorter metal engaging portion 736 to achieve mating fixation of the first connector 500 to the second connector 100.

FIG. 8 to FIG. 10 illustrate the two first inner shells 750 of the embodiment as plate-like metal members. The plate surface of the first inner shell 750 is disposed along the third direction inside the first insulator 600. More specifically, the first inner shell 750 is mated with the first inner shell housing 640 as the hole formed in the first insulator 600, and mounted thereto. The holes of the first inner shell housings 640 are formed at the respective ends of the two wall surfaces in parallel arrangement to constitute the first electric terminal housing 630. The wall surface of the first electric terminal housing 630 is parallel to the second direction. The first inner shell 750 is mated with the first inner shell housing 640 as the hole so that the respective plate surfaces of the two first inner shells 750 are arranged in parallel with each other along the third direction orthogonal to the second direction.

Referring to FIG. 10, the upper ends of the first inner shells 750 of the embodiment are soldered to circuit patterns (not shown) on the first circuit board 860 when fixing the first connector 500 to the first circuit board 860. This allows the first inner shell 750 to have the ground potential as the ground conductor.

Referring to FIG. 8 to FIG. 10, the first electric terminal 800 of the embodiment is formed as the conductive member. The plurality of first electric terminals 800 are held by the first electric terminal housing 630. More specifically, there are four first electric terminals 800 in the embodiment. Meanwhile, the first electric terminal housing 630 is constituted by the two wall surfaces in parallel arrangement in the third direction. Each of the two wall surfaces has two recess portions. The first electric terminal 800 is mated with the recess portion of the first electric terminal housing 630 so as to be held thereby. That is, the first insulator 600 holds the plurality of first electric terminals 800. The first electric terminals 800 are disposed between the two first inner shells 750.

Referring to FIG. 8 to FIG. 10, and FIG. 12, the first high frequency signal terminal 850 of the embodiment is formed as the conductive member. The first high frequency signal terminal 850 has an inverted L-like shape in the vertical sectional view seen from the first direction. The first high frequency signal terminal 850 is mated with the first high frequency signal terminal housing 650 formed as the hole so as to be held. More specifically, the first high frequency signal terminals 850 are disposed in two regions each interposed between the first outer shell 700 and the first inner shell 750, respectively. The first high frequency signal terminals 850 are mated with the respective first high frequency signal terminal housings 650 each formed as the hole so that the two first high frequency signal terminals 850 are fixed.

Figure 13:
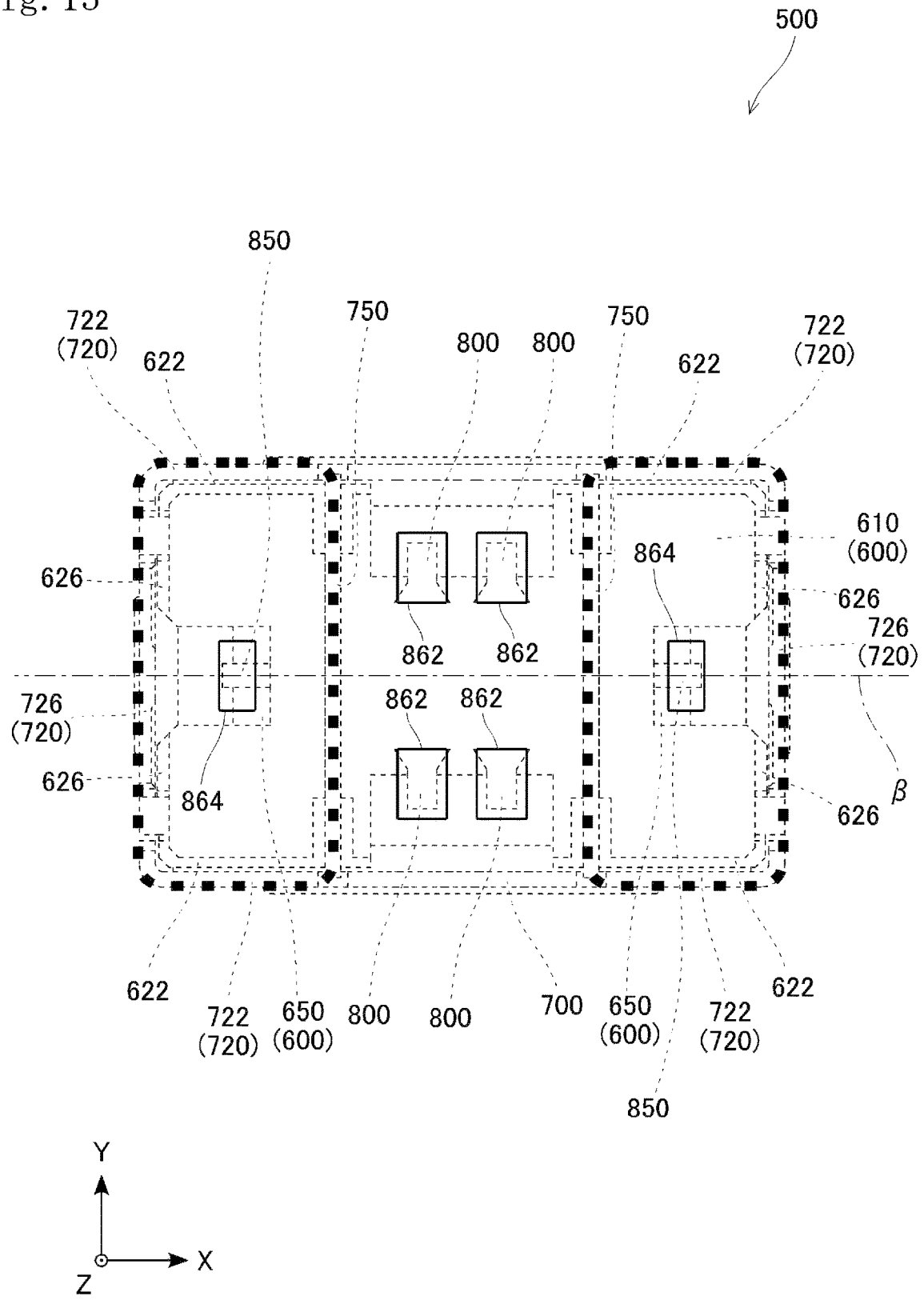
FIG. 13 schematically illustrates characteristics of the first connector of FIG. 8, having the first connector indicated by a thin dashed line, a part of a circuit pattern indicated by a solid line, and a characteristic part of the first connector of the embodiment enclosed by a bold dashed line.

Referring to FIG. 13, upper ends of the first electric terminals 800 and the first high frequency signal terminals 850 of the embodiment are soldered to electric circuit patterns 862 and high frequency signal circuit patterns 864 on the first circuit board 860, respectively when the first connector 500 is fixed to the first circuit board 860. In the embodiment, connection between the electric circuit pattern 862 and the first electric terminal 800 allows power supply and transmission of general electric signals. In the embodiment, connection between the high frequency signal circuit pattern 864 and the first high frequency signal terminal 850 allows transmission of high frequency signals.

Figure 14:
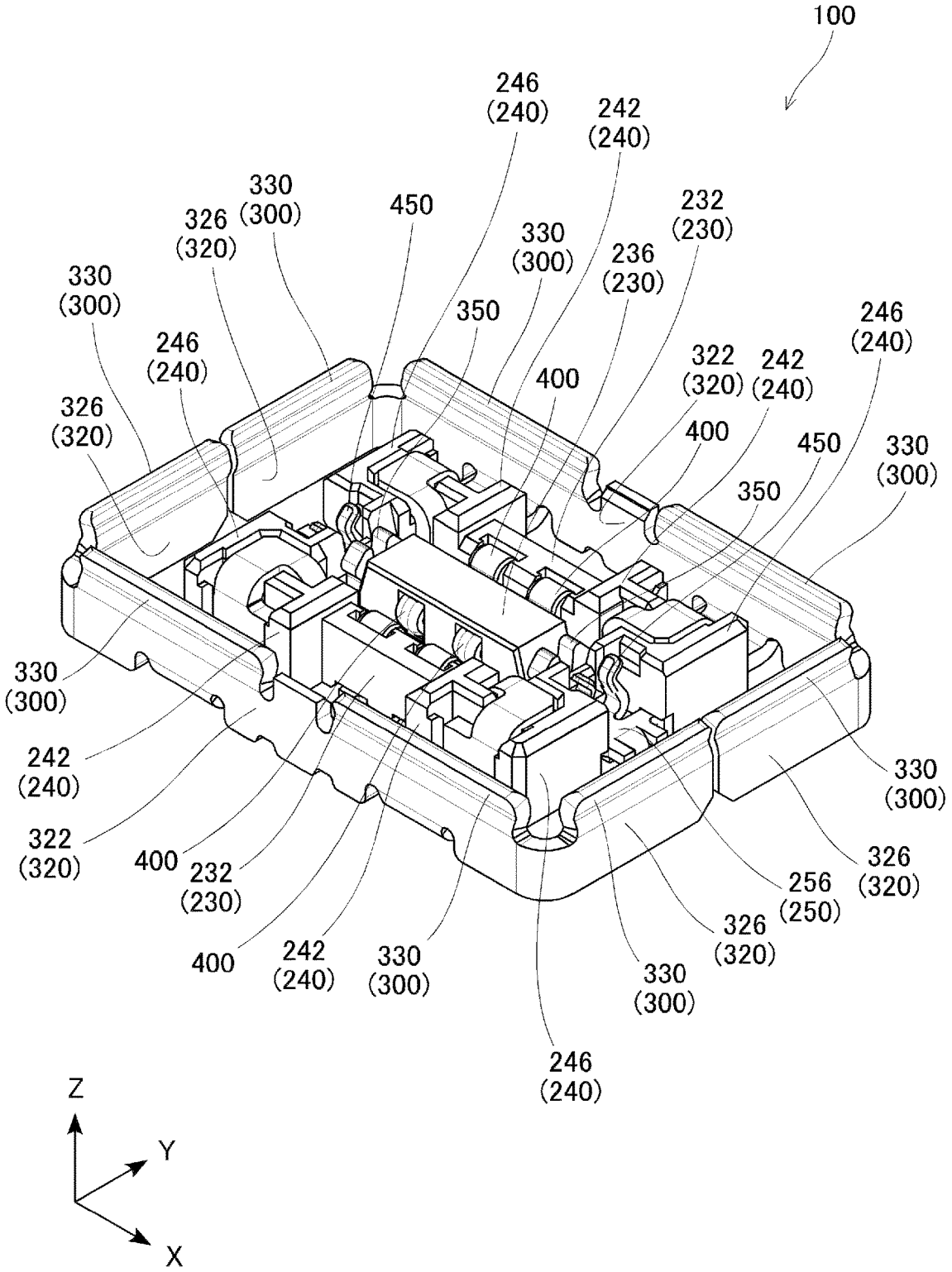
FIG. 14 is an upper perspective view of a second connector of the connector assembly as illustrated in FIG. 1.

As FIG. 14 illustrates, the second connector 100 of the embodiment is fixed to a second circuit board 460 which is different from the first circuit board 860.

As FIG. 14 illustrates, the second connector 100 of the embodiment includes a second insulator 200, a second outer shell 300 disposed to surround the second insulator 200, two second inner shells 350 mounted inside the second insulator 200, a plurality of second electric terminals 400 disposed between the two second inner shells 350, and two second high frequency signal terminals 450 disposed in a region interposed between the second outer shell 300 and the second inner shell 350. The number of the second electric terminals 400 may be at least one without being limited to the number as described in the embodiment. The second connector 100 may be constituted by the second insulator 200, the second outer shell 300, the second inner shells 350, and the second high frequency signal terminals 450. That is, the second connector 100 does not have to include the second electric terminals 400.

Figure 3:
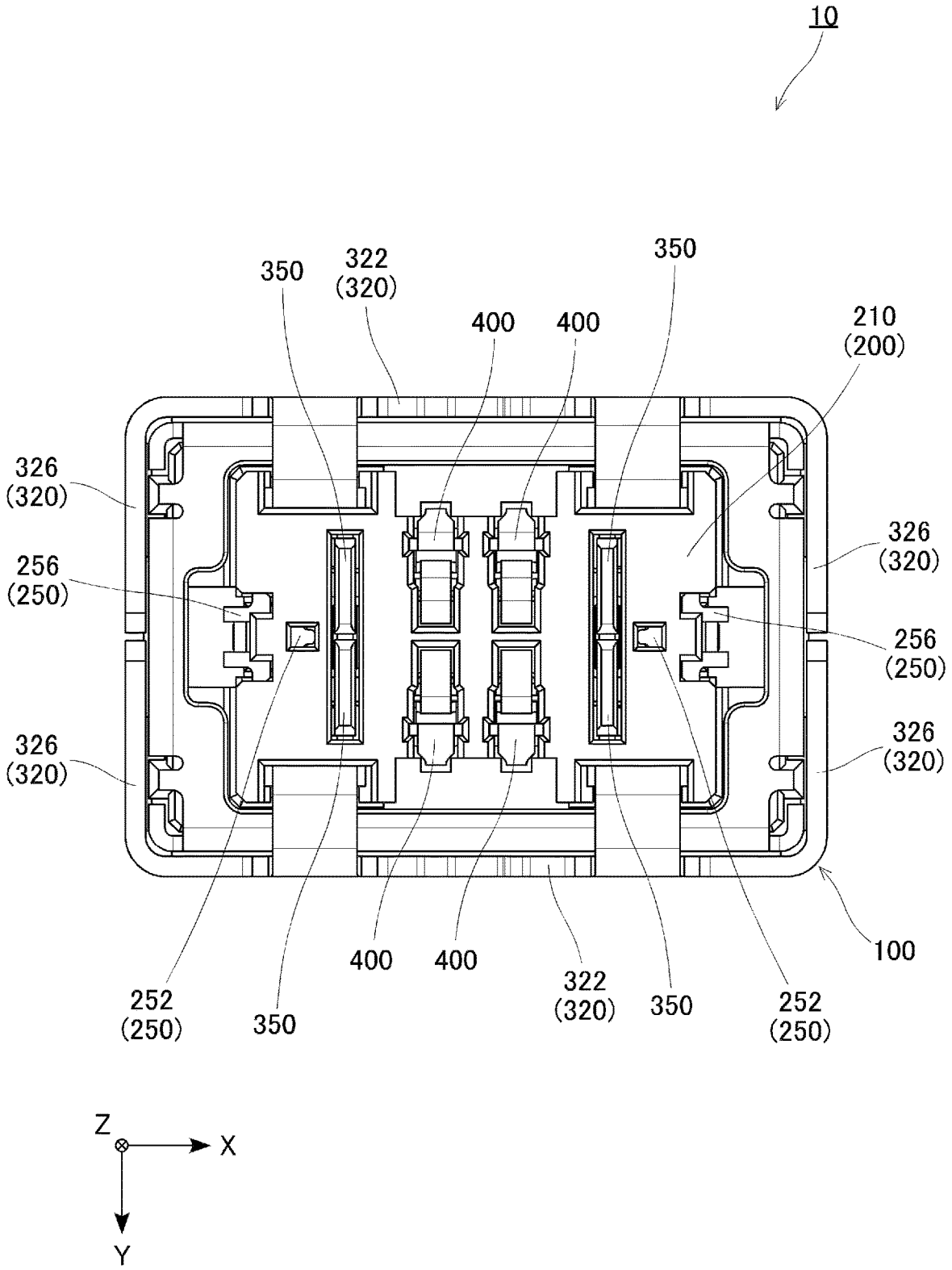
FIG. 3 is a bottom view of the connector assembly of FIG. 1.
Figure 15:
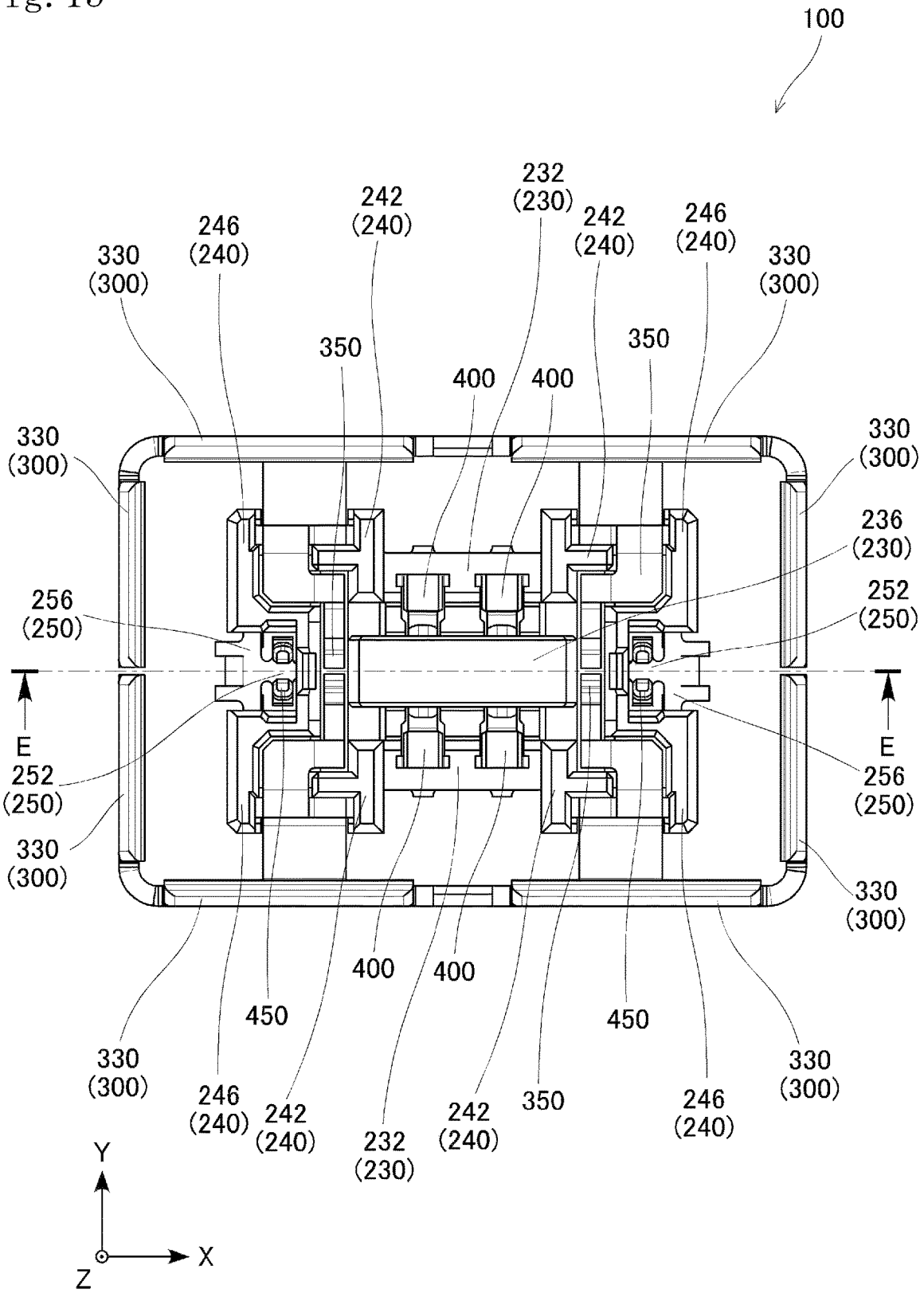
FIG. 15 is a top view of the second connector of FIG. 14.

Referring to FIG. 3, FIG. 14 and FIG. 15, in the embodiment, the second insulator 200 made of resin includes a bottom surface portion 210, a second electric terminal housing 230, a second inner shell housing 240 and a second high frequency signal terminal housing 250.

Figure 16:
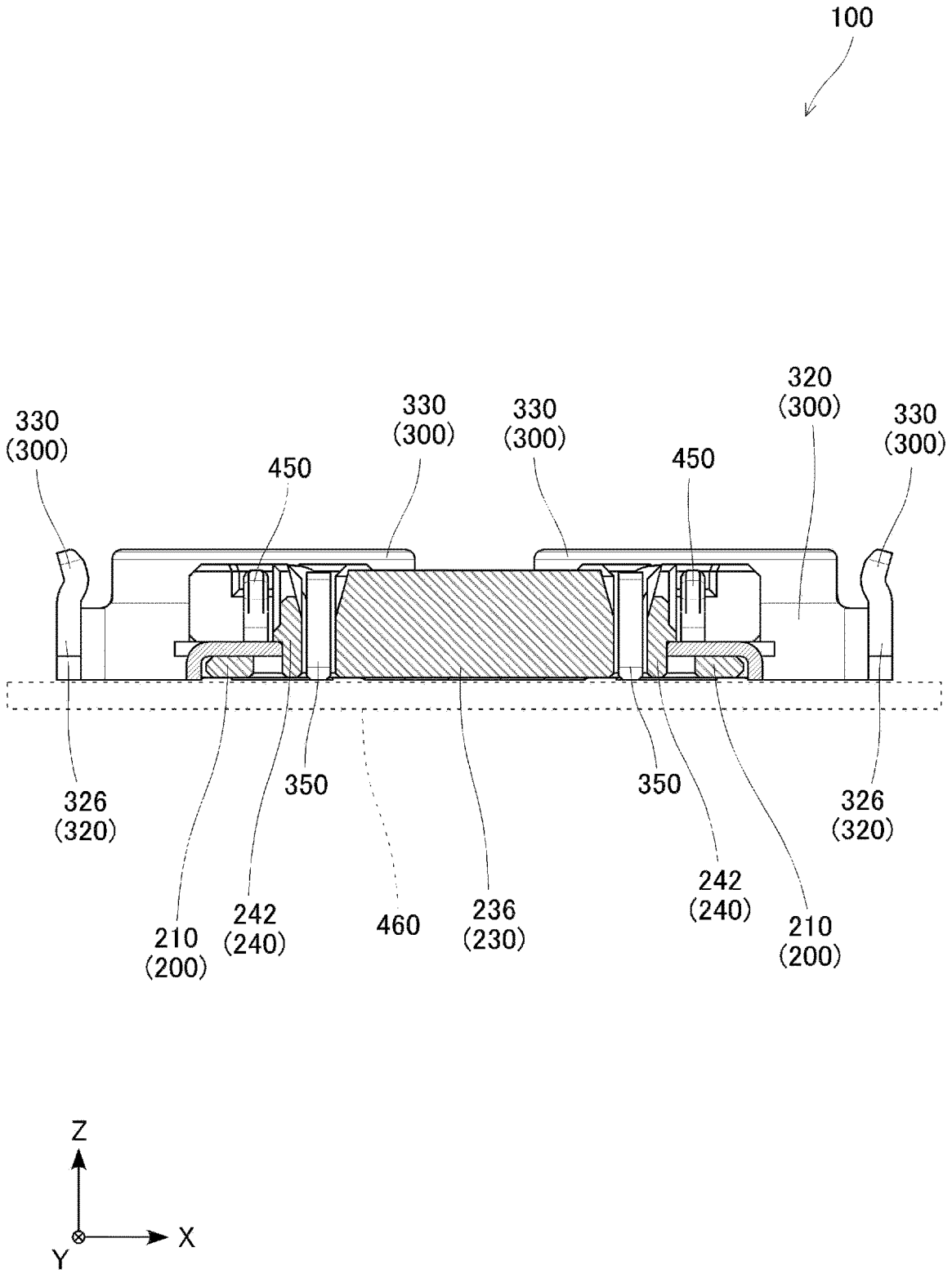
FIG. 16 is a sectional view of the second connector taken along line E-E of FIG. 15, having the second circuit board indicated by a dashed line.
Figure 17:
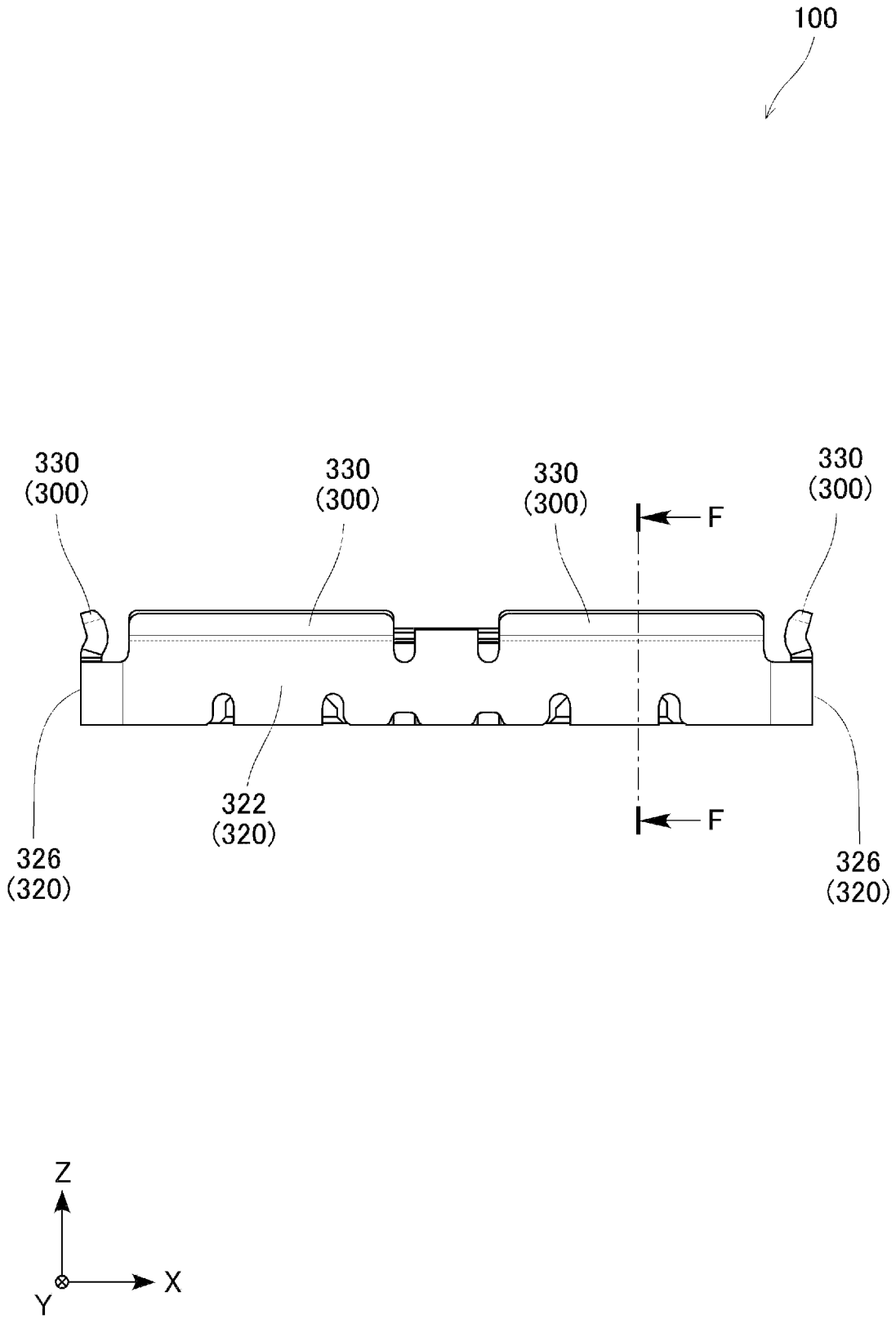
FIG. 17 is a front view of the second connector of FIG. 14, having the second circuit board indicated by a dashed line.
Figure 18:
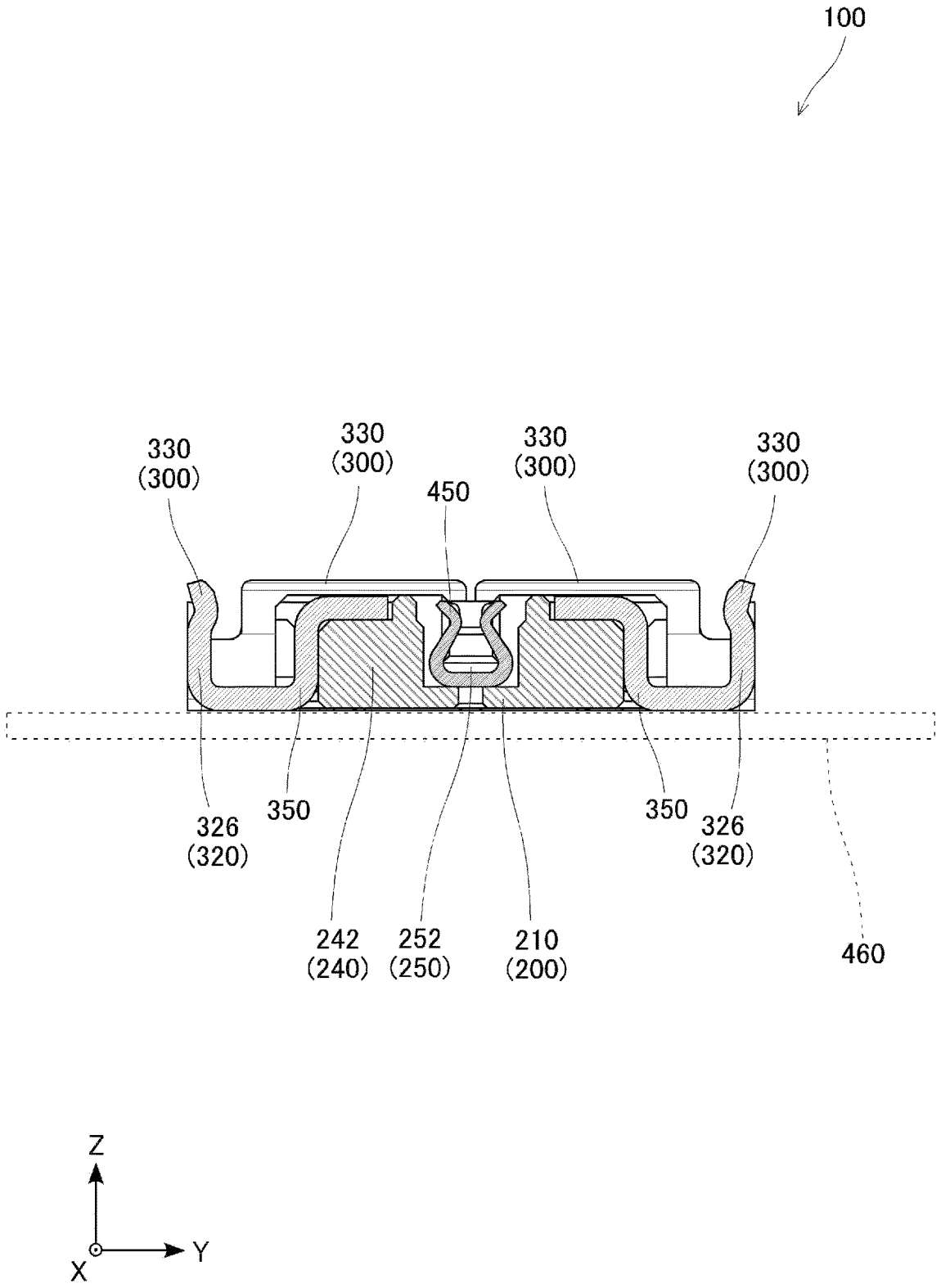
FIG. 18 is a sectional view of the second connector taken along line F-F of FIG. 17, having the second circuit board indicated by a dashed line.

As FIG. 15, FIG. 16 and FIG. 18 illustrate, the bottom surface portion 210 of the embodiment has a flat H-like plate shape orthogonal to the up-down direction, and defines a lower end of the second insulator 200.

As FIG. 14 to FIG. 16 illustrate, the second electric terminal housing 230 of the embodiment includes two insulating planes 232 and an island-like portion 236.

As FIG. 14 and FIG. 15 illustrate, the insulating plane 232 of the embodiment is orthogonal to the first direction, that is, the up-down direction. As FIG. 15 illustrates, the insulating planes 232 are positioned around both ends of the bottom surface portion 210 in the third direction. The insulating planes 232 are located at two positions at the positive Y side and the negative Y side in the second direction, respectively.

As FIG. 14 and FIG. 15 illustrate, the island-like portion 236 of the embodiment protrudes upward from the bottom surface portion 210 toward the first direction. As FIG. 15 illustrates, the island-like portion 236 has its both side surfaces in the third direction surrounded by the insulating planes 232 in the plane orthogonal to the up-down direction. That is, the island-like portion 236 is interposed between the two insulating planes 232 in the plane orthogonal to the up-down direction. The island-like portion 236 is located at an intermediate position between the two insulating planes 232 in the third direction.

As FIG. 14 to FIG. 16 illustrate, the second inner shell housing 240 of the embodiment includes two second inner walls 242 and two second outer walls 246 for holding and storing the second inner shell 350.

As FIG. 14 illustrates, each of the second inner walls 242 of the embodiment has a T-like wall surface when viewed along the up-down direction. The second inner wall 242 is disposed to have the lower end of the vertically extending T-like section directed outward in the second direction. The lower end of the second inner wall 242 is connected to the bottom surface portion 210.

As FIG. 14 illustrates, each of the second outer walls 246 of the embodiment has an L-like wall surface when viewed along the up-down direction. The second outer wall 246 has a vertically extending L-like section disposed at the periphery of the bottom surface portion 210 in the second direction and disposed along the third direction. The lower end of the second outer wall 246 is connected to the bottom surface portion 210.

When viewed along the up-down direction, the second inner shell 350 is housed and held by a pair of the two T-like second inner walls 242 and the two L-like second outer walls 246. The two second inner shells 350 are stored and held by the two pairs of the two second inner walls 242 and the two second outer walls 246.

As FIG. 14, FIG. 15 and FIG. 18 illustrate, the second high frequency signal terminal housing 250 of the embodiment includes a convex portion 252 for housing and fixing the second high frequency signal terminal 450, and a flat plate mount portion 256 to be inserted between the two second outer walls 246 for fixation. Each of the two second high frequency signal terminals 450 is disposed in a region between the second outer shell 300 and the second inner shell 350. The second high frequency signal terminal housings 250 are formed at the positions corresponding to the two mount positions of the second high frequency signal terminals 450, respectively.

As FIG. 14, FIG. 15 and FIG. 18 illustrate, the second high frequency signal terminal housing 250 of the embodiment may be disposed between the two second outer walls 246. Specifically, the flat plate mount portion 256 of the second high frequency signal terminal housing 250 is inserted between the two second outer walls 246 in parallel arrangement in the third direction on the periphery of the bottom surface portion 210 in the second direction while being directed to the inside along the second direction from the outside. This allows the second high frequency signal terminal housing 250 to be disposed between the two second outer walls 246.

As FIG. 14, FIG. 15 and FIG. 18 illustrate, when mounting the second high frequency signal terminal housing 250 of the embodiment, the convex portion 252 of the second high frequency signal terminal housing 250 is disposed while being directed inward along the second direction. As FIG. 18 illustrates, a vertical sectional view in the up-down direction as the first direction of the second high frequency signal terminal 450 to be described later has a pot-like shape having a C-like opening expanding outward when viewed from the second direction. The convex portion 252 is inserted inward of a C-like closed section so that the second high frequency signal terminal 450 is gripped and fixed between the convex portion 252 and the bottom surface portion 210.

Referring to FIG. 14 to FIG. 16, the second electric terminal 400 of the embodiment is formed as the conductive member. The plurality of second electric terminals 400, specifically, four in the embodiment are held in the second electric terminal housing 230. Meanwhile, the second electric terminal housing 230 includes the two insulating planes 232 and the island-like portion 236. The insulating planes 232 are located around both ends of the bottom surface portion 210 in the third direction. The island-like portion 236 protrudes upward from the bottom surface portion 210 toward the first direction. The island-like portion 236 is interposed between the two insulating planes 232 in the plane orthogonal to the up-down direction. The second electric terminals 400 are inserted into two gaps in parallel arrangement in the second direction between the two insulating planes 232 and the island-like portion 236, respectively so that the second electric terminal housing 230 is mated with the gaps. The second electric terminals 400 are then held by the second electric terminal housing 230. That is, the second insulator 200 holds the plurality of second electric terminals 400. The second electric terminals 400 are disposed between the two second inner shells 350 to be described later.

Referring to FIG. 14 to FIG. 16, and FIG. 18, the second high frequency signal terminal 450 of the embodiment is formed as the conductive member, and has a vertical sectional view in the up-down direction as the first direction has the pot-like shape having the C-like opening expanding outward when viewed from the second direction. The convex portion 252 of the second high frequency signal terminal housing 250 is inserted inward of the C-like closed section so that the second high frequency signal terminal 450 is gripped and fixed between the convex portion 252 and the bottom surface portion 210.

Figure 19:
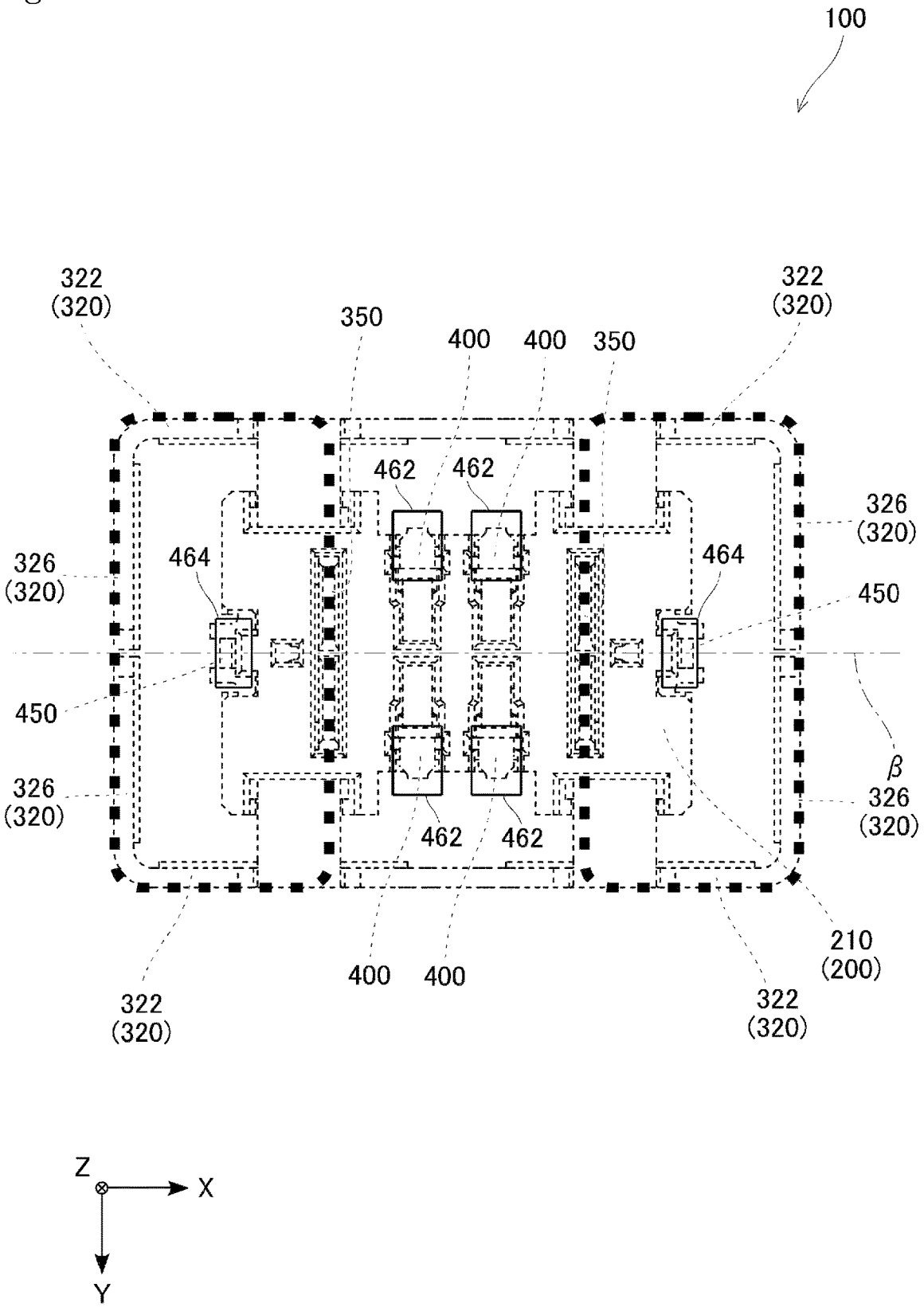
FIG. 19 schematically illustrates characteristics of the second connector of FIG. 14, having the second connector indicated by a thin dashed line, a part of the circuit pattern indicated by a solid line, and a characteristic part of the second connector of the embodiment enclosed by a bold dashed line.

Referring to FIG. 19, in the embodiment, when the second connector 100 is fixed to the second circuit board 460, lower ends of the second electric terminals 400 and the second high frequency signal terminals 450 are soldered to electric circuit patterns 462 and high frequency signal circuit patterns 464 on the second circuit board 460, respectively. In the embodiment, connection between the electric circuit pattern 462 and the second electric terminal 400 allows power supply and transmission of general electric signals. In the embodiment, connection between the high frequency signal circuit pattern 464 and the second high frequency signal terminal 450 allows transmission of high frequency signals.

FIG. 14 to FIG. 16 illustrate the two second inner shells 350 of the embodiment, each formed as a plate-like metal member. Each plate surface of the second inner shells 350 is disposed along the third direction inside the second insulator 200. Specifically, each of the two second inner shells 350 is gripped in each gap between the two second inner walls 242 and the two second outer walls 246, which constitute the second inner shell housing 240 of the second insulator 200 so that the two second inner shells 350 are mounted. The direction of the gap with which the second inner shell 350 is mounted is parallel to the third direction. The second inner shells 350 are mated with the second inner shell housings 240 formed as the gaps so that the plate surfaces of the two second inner shells 350 are arranged in parallel along the second direction orthogonal to the third direction.

Referring to FIG. 16, when the second connector 100 is fixed to the second circuit board 460, lower ends of the second inner shells 350 of the embodiment are soldered to circuit patterns (not shown) on the second circuit board 460. This allows the second inner shell 350 to have a ground potential as the ground conductor.

As FIG. 15 illustrates, the second outer shell 300 of the embodiment is connectedly held by the second inner shells 350. Specifically, the second outer shell 300 is connected to the second inner shells 350 at both ends of the two second inner shells 350 extending outward in the third direction, that is, at four positions in total.

Referring to FIG. 14 and FIG. 15, the second outer shell 300 of the embodiment has a substantially quadrilateral outer shape when viewed from the first direction. When viewed from the up-down direction as the first direction, the second outer shell 300 made of metal is constituted by the two second metal peripheral portions 320 each having a U-like shape, which are disposed to have opening sections facing with each other. Upwardly extending second metal engaging portions 330 are formed on the two second metal peripheral portions 320. In other words, the second outer shell 300 of the embodiment is configured by arranging a pair of U-like members in the top view to face with each other. The U-like member is constituted by the second metal peripheral portion 320 and the second metal engaging portion 330.

As FIG. 14 illustrates, the second metal peripheral portion 320 of the embodiment includes second longer metal walls 322 and second shorter metal walls 326.

As indicated by FIG. 14, the second longer metal wall 322 of the embodiment is disposed along the second direction orthogonal to the first direction. The second longer metal walls 322 are located at outer ends of the bottom surface portion 210 of the second insulator 200 in the third direction.

As indicated by FIG. 14, the second shorter metal walls 326 of the embodiment extend along the third direction between opposite ends of the second longer metal walls 322. The second shorter metal walls 326 are located at outer ends of the bottom surface portion 210 of the second insulator 200 in the second direction.

As indicated by FIG. 15, the second metal peripheral portion 320 of the embodiment is fixed by connecting the second longer metal walls 322 and ends of the two second inner shells 350. In other words, the second longer metal walls 322 of the second metal peripheral portion 320 are fixed by the ends of the second inner shells 350. Meanwhile, the second shorter metal walls 326 of the second metal peripheral portion 320 have inner sides bendable as free ends.

As indicated by FIG. 14, the second metal engaging portion 330 of the embodiment is curved inward with a curvature. As indicated by FIG. 4 and FIG. 6, the second metal engaging portion 330 comes in contact with the first longer metal engaging portion 732 and the first shorter metal engaging portion 736 of the first connector 500, and is pressed to receive the force to incline toward the outer periphery of the second outer shell 300. The inclining force generates elastic force in the second metal engaging portions 330 of the second outer shell 300 and the second shorter metal walls 326 as the metal members. The generated elastic force is applied to the second metal engaging portion 330, the second shorter metal wall 326, and the first longer metal engaging portion 732 and the first shorter metal engaging portion 736 of the first connector 500 so as to achieve mating fixation of the first connector 500 to the second connector 100.

Referring to FIG. 16 and FIG. 18, when fixing the second connector 100 to the second circuit board 460, each lower end of the second longer metal walls 322 and the second shorter metal walls 326 of the second metal peripheral portion 320 of the embodiment is soldered to the circuit pattern (not shown) on the second circuit board 460. This allows the second outer shell 300 to have a ground potential as the ground conductor.

Referring to FIG. 13 and FIG. 19, the connector assembly 10 of the embodiment including the first connector 500 and the second connector 100 is provided with the two first high frequency signal terminals 850 and the two second high frequency signal terminals 450. The first high frequency signal terminals 850 and the second high frequency signal terminals 450 are surrounded by the first outer shell 700, the second outer shell 300, and the first inner shell 750, the second inner shell 350, respectively when viewed from the first direction.

More specifically, as FIG. 13 illustrates, as for the first connector 500, the first high frequency signal terminal 850 is surrounded by the two first longer metal walls 722 and the first shorter metal wall 726, which constitute the first metal peripheral portion 720 of the first outer shell 700, and the first inner shell 750 (see bold dashed line of FIG. 13).

As FIG. 19 illustrates, as for the second connector 100, the second high frequency signal terminal 450 is surrounded by the two second longer metal walls 322 and the two second shorter metal walls 326, which constitute the second metal peripheral portion 320 of the second outer shell 300, and the second inner shell 350 (see bold dashed line of FIG. 19).

As FIG. 13 illustrates, a second symmetry axis β refers to the center line of the first outer shell 700 of the first connector 500 of the embodiment, extending along the second direction orthogonal to the first direction in which the first high frequency signal terminals 850 are arranged in the first outer shell 700. In the foregoing case, the first high frequency signal terminals 850, the first outer shell 700 surrounding the periphery of the first high frequency signal terminals 850 (two first longer metal walls 722 and the first shorter metal wall 726), and the first inner shell 750 are disposed on the second symmetry axis β to form a linearly symmetrical shape.

As FIG. 19 illustrates, the second symmetry axis β refers to the center line of the second outer shell 300 of the second connector 100 of the embodiment, extending along the second direction orthogonal to the first direction in which the second high frequency signal terminals 450 are arranged. In the foregoing case, the second high frequency signal terminals 450, the second outer shell 300 surrounding the periphery of the second high frequency signal terminals 450 (two second longer metal walls 322 and the two second shorter metal walls 326), and the second inner shell 350 are disposed on the second symmetry axis β to form a linearly symmetrical shape.

That is, in the connector assembly 10 of the embodiment, each of the quasi-coaxial structures constituted by the high frequency signal terminals 450, 850, the outer shells 300, 700 surrounding peripheries of the terminals, and the inner shells 350, 750 for impedance matching has the linearly symmetrical shape. In the case where wirings on the circuit boards 460, 860 connected to the high frequency signal terminals 450, 850 extend in the direction orthogonal to each of the center lines (second symmetry axis β) of the outer shells 300, 700, even if lead-out directions of all the wirings on the circuit boards 460, 860 are not the same, the transmission line configuration is kept unchanged.

Figure 7:
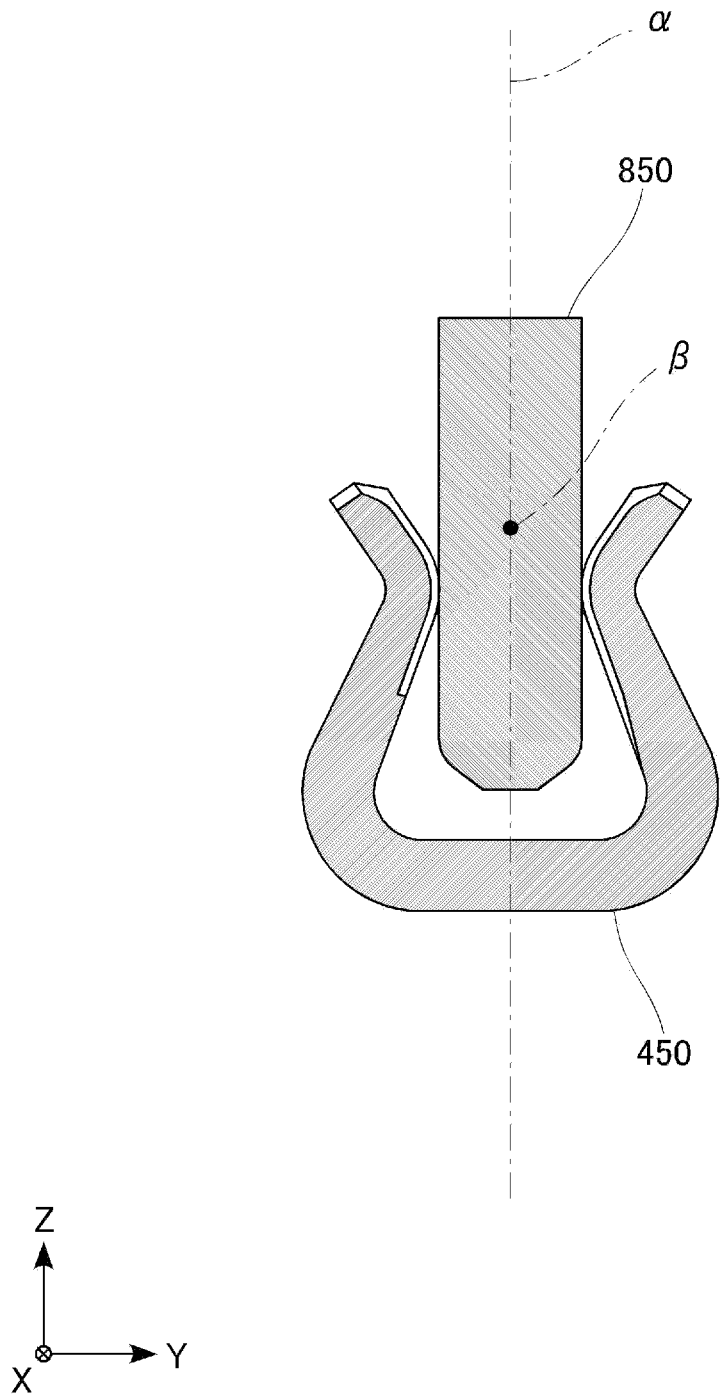
FIG. 7 is an enlarged sectional view of an essential part of the connector assembly of FIG. 6.

Referring to FIG. 7, a first symmetry axis α refers to the center line of the high frequency signal terminals 450, 850 of the connector assembly 10 of the embodiment including the first connector 500 and the second connector 100, extending along the first direction orthogonal to the second symmetry axis β in the sectional view of the high frequency signal terminals 450, 850 along the first direction when viewed from the second direction. The high frequency signal terminals 450, 850 form the linearly symmetrical shape.

In the connector assembly 10 of the embodiment, the high frequency signal terminals 450, 850 form the symmetrical structure. In the case where the wirings on the circuit boards 460, 860 connected to the high frequency signal terminals 450, 850 extend in the direction orthogonal to the center line (second symmetry axis β) of the outer shells 300, 700, even if the lead-out directions of all the wirings on the circuit boards 460, 860 are not the same, no difference occurs in the impedance characteristics.

Accordingly, in the case where the wirings on the circuit boards 460, 860 connected to the high frequency signal terminals 450, 850 in the connector assembly 10 of the embodiment extend in the direction orthogonal to the center line of the outer shells 300, 700, even if the lead-out directions of all the wirings on the circuit boards 460, 860 are not the same, the transmission line configuration for impedance matching is kept unchanged. It is possible to provide the connector assembly 10 which causes no difference in the transmission characteristics even if directions of all the wirings are not the same. The effect becomes advantageous especially when the connector assembly 10 of the embodiment is used as the board-to-board connector assembly.

Operations for mating the first connector 500 with the second connector 100 to form the connector assembly 10 of the embodiment will be described hereinafter.

Referring to FIG. 4, FIG. 10 and FIG. 16, the first connector 500 and the second connector 100 are positioned so that the first longer metal walls 722 and the first shorter metal walls 726 of the first metal peripheral portion 720 of the first connector 500 face the second metal engaging portions 330 of the second connector 100 in the up-down direction. At this time, the first longer metal walls 722 and the first shorter metal walls 726 of the first metal peripheral portion 720 of the first connector 500 are opposed to the second metal engaging portions 330 of the second connector 100 in the up-down direction.

After the positioning, the first connector 500 and the second connector 100 are moved closer to each other in the up-down direction so that the first connector 500 is partially inserted into the second connector 100 in the up-down direction. At this time, the first longer metal walls 722 and the first shorter metal walls 726 of the first metal peripheral portion 720 of the first connector 500 are partially housed in the second metal engaging portions 330 of the second connector 100.

As the first connector 500 and the second connector 100 are further moved closer to each other in the up-down direction, the first longer metal engaging portion 732 formed on the outer periphery of the first longer metal wall 722 and the first shorter metal engaging portion 736 formed on the outer periphery of the first shorter metal wall 726 are moved downward while coming in contact with inner peripheral surfaces of the second metal engaging portions 330 each inwardly curved with the curvature to apply insertion force for inserting the first connector 500 into the second connector 100.

Partial insertion of the first connector 500 into the second connector 100 is started in the state where the respective terminals are positioned. That is, the first electric terminal 800 of the first connector 500 and the second electric terminal 400 of the second connector 100, the first high frequency signal terminal 850 of the first connector 500 and the second high frequency signal terminal 450 of the second connector 100, and the first inner shell 750 of the first connector 500 and the second inner shell 350 of the second connector 100 are brought into the partially inserted state or partially contact state, respectively.

Upon application of the force to the connector assembly 10 so as to further bring the first connector 500 and the second connector 100 closer to each other in the up-down direction, the first longer metal engaging portion 732 and the first shorter metal engaging portion 736 of the first connector 500 are moved downward while coming in contact with the second metal engaging portions 330 of the second connector 100. The force for inserting the first connector 500 into the second connector 100 is maximized at the time point when the respective center positions of the first longer metal engaging portion 732 and the first shorter metal engaging portion 736 in the first direction come in contact with each top portion of the curved sections of the second metal engaging portions 330.

After the foregoing contact state, as the force is continuously applied to the connector assembly 10 to further bring the first connector 500 and the second connector 100 closer to each other in the up-down direction, the respective center positions of the first longer metal engaging portion 732 and the first shorter metal engaging portion 736 in the first direction are moved downward over each top portion of the curved sections of the second metal engaging portions 330. The respective upper curved surfaces of the first longer metal engaging portion 732 and the first shorter metal engaging portion 736 of the first connector 500 come in contact with each lower curved surface of the curved sections of the second metal engaging portions 330. From the time point onward when the first longer metal engaging portion 732 and the first shorter metal engaging portion 736 of the first connector 500 run over each top portion of the curved sections of the second metal engaging portions 330 of the second connector 100, the insertion force applied for inserting the first connector 500 into the second connector 100 will be reduced. The contact between the upper curved surfaces of the first longer metal engaging portion 732 and the first shorter metal engaging portion 736 of the first connector 500 and the lower curved surfaces of the curved sections of the second metal engaging portions 330 stabilizes mating of the first connector 500 with the second connector 100.

In transition from the state where the insertion force is reduced to the state where the mating is stabilized, the state of partial insertion of terminals of the first connector 500 into those of the second connector 100 is shifted to reach the normal mating position to complete operations for mating the first connector 500 with the second connector 100 to form the connector assembly 10 of the embodiment.

The preferred embodiment of the present invention has been described. It is to be understood that the technical scope of the present invention is not limited to that of the embodiment. It is possible to variously change and modify the embodiment.

In the embodiment as described above, for example, the outer shell (first outer shell 700, second outer shell 300) has a substantially quadrilateral outer shape when viewed from the first direction. In the present invention, however, the outer shell may be formed by combining a plurality of components rather than the single quadrilateral component. The outer shell according to the present invention may have a tiny gap between components so long as it has the substantially quadrilateral shape. The shape of the outer shell according to the present invention when viewed from the first direction is not limited to the parallelogram but may be quadrilateral having a curved side such as an oval so long as its center line is substantially clarified. The shape of the outer shell according to the present invention when viewed from the first direction may be formed by combining a straight line and a section curved into an arc shape, for example, a track shape so long as the center line of the quadrilateral is substantially clarified.

Single-ended terminals of the single-ended transmission are expected to be employed for the high frequency signal terminals (second high frequency signal terminal 450, first high frequency signal terminal 850) in the above-described embodiment, for example. In the single-ended transmission as one of systems for transmitting digital data via signal lines, the voltage level of the signal is expressed as either "1" or "0" on the basis of the given voltage. The signal "1" refers to the signal with higher voltage than the given voltage, and the signal "0" refers to the signal with lower voltage than the given voltage. It is possible to employ the high frequency signal terminals according to the present invention through any other transmission system, for example, the differential transmission system without being limited to the single-ended transmission system.

Figure 20:
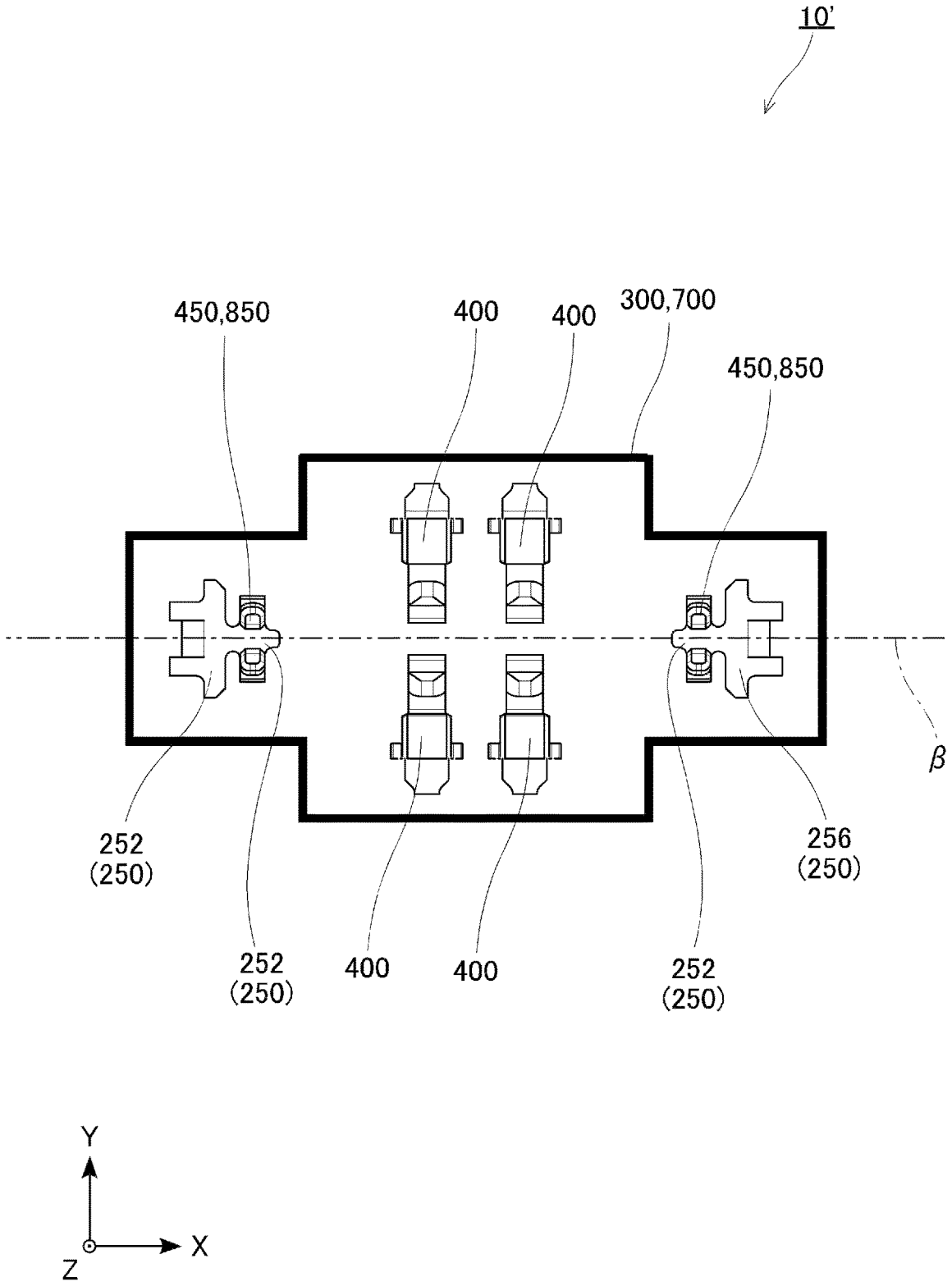
FIG. 20 is a schematic top view of one of various modified examples of the connector assembly according to the present invention.
Figure 21:
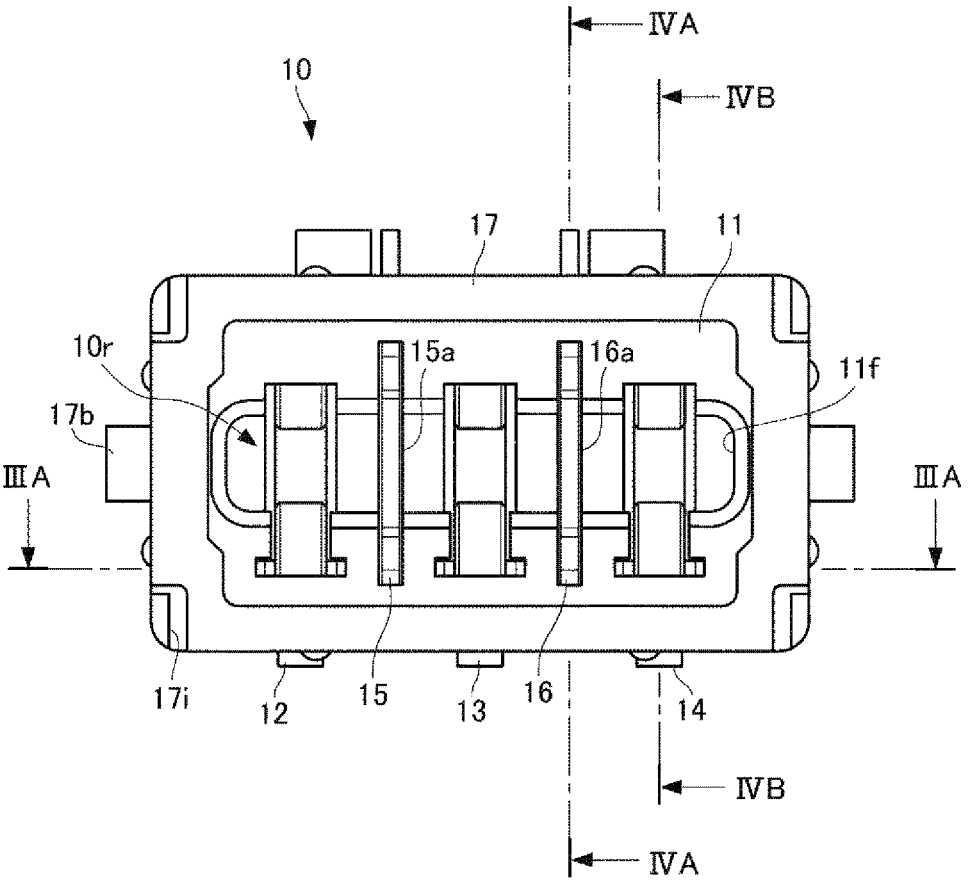
FIG. 21 is a plan view of an example indicating a schematic structure of one side (receptacle) of the connector constituting the connector assembly (set of male and female connectors) of Patent Document 1.

The connector assembly according to the present invention may be modified as illustrated in FIG. 20, for example. In FIG. 20, members identical or similar to those of the above-described embodiment will be denoted by the same codes, and thus explanations thereof will be omitted.

That is, a connector assembly 10' as a modified example includes the first connector 500 and the second connector 100. The first connector 500 is mateable with and removable from the second connector 100 along the first direction. The first connector 500 and the second connector 100 of the connector assembly 10' include the outer shells 300, 700, and at least two units of the high frequency signal terminals 450, 850, respectively. The high frequency signal terminals 450, 850 are disposed adjacent to the outer shells 300, 700, respectively when viewed from the first direction to form the quasi-stripline structure. The second symmetry axis β refers to the center line of the outer shells 300, 700 along the direction orthogonal to the first direction in which the high frequency signal terminals 450, 850 are arranged. The quasi-stripline structure constituted by the high frequency signal terminals 450, 850 and the adjacent outer shells 300, 700, which are disposed on the second symmetry axis β has the linearly symmetrical shape.

The connector assembly 10' as the modified example has the outer shells 300, 700, each having a polygonal shape with notched four corners of the rectangle. The outer shell according to the present invention may be formed to have the parallelogram and the shape with curved side such as the oval rather than the polygonal shape so long as the center line of the quadrilateral shape is substantially clarified when viewed from the first direction. The outer shell according to the present invention may be formed by combining a straight line and a section curved into an arc shape when viewed from the first direction such as the track shape so long as the center line of the quadrilateral is substantially clarified.

The connector assembly 10' as the modified example has the linearly symmetrical quasi-stripline structure constituted by the high frequency signal terminals 450, 850 and the adjacently disposed outer shells 300, 700 for impedance matching. In the case where the wirings on the circuit boards 460, 860 connected to the high frequency signal terminals 450, 850 extend in the direction orthogonal to the center lines (second symmetry axis β) of the outer shells 300, 700, the transmission line configuration is kept unchanged even if lead-out directions of all the wirings on the circuit boards 460, 860 are not the same.

In the connector assembly 10' as the modified example, in which the wirings on the circuit boards 460, 860 connected to the high frequency signal terminals 450, 850 extend in the direction orthogonal to the center lines of the outer shells 300, 700, the transmission line configuration for impedance matching is kept unchanged even if the lead-out directions of all the wirings on the circuit boards 460, 860 are not the same. Accordingly, it is possible to provide the connector assembly 10' which causes no difference in the transmission characteristics even if directions of all wirings are not the same. The effect becomes advantageous especially when the connector assembly 10' as the modified example is used as the board-to-board connector assembly.

In light of the description of claims, it is clear that such changes and modifications made to the embodiment fall within the technical scope of the present invention.

REFERENCE SIGNS LIST

10, 10' connector assembly
100 second connector (connector)
200 second insulator
210 bottom surface portion
230 second electric terminal housing
232 insulating plane
236 island-like portion
240 second inner shell housing
242 second inner wall
246 second outer wall
250 second high frequency signal terminal housing
252 convex portion
256 flat plate mount portion
300 second outer shell (outer shell)
320 second metal peripheral portion
322 second longer metal wall
326 second shorter metal wall
330 second metal engaging portion
350 second inner shell (inner shell)
400 second electric terminal
450 second high frequency signal terminal (high frequency signal terminal)
460 second circuit board
462 electric circuit pattern
464 high frequency signal circuit pattern
500 first connector (connector)
600 first insulator
610 upper surface portion
620 first peripheral portion
622 first longer wall
626 first shorter wall
630 first electric terminal housing
640 first inner shell housing
650 first high frequency signal terminal housing
660 first outer shell fixing portion

700 first outer shell (outer shell)
710 first metal plane
720 first metal peripheral portion
722 first longer metal wall
726 first shorter metal wall
730 first metal engaging portion
732 first longer metal engaging portion
736 first shorter metal engaging portion
750 first inner shell (inner shell)
800 first electric terminal
850 first high frequency signal terminal (high frequency signal terminal)
862 electric circuit pattern
864 high frequency signal circuit pattern
860 first circuit board
α first symmetry axis
β second symmetry axis

What is claimed is:

1. A connector assembly comprising:

a first connector and a second connector, the first connector being mateable with and removable from the second connector along a first direction, wherein each of the first connector and the second connector includes at least two high frequency signal terminals, when viewed from the first direction, each periphery of the high frequency signal terminals is surrounded by an outer shell and an inner shell, the outer shell has a substantially quadrilateral shape, the high frequency signal terminals, the outer shells surrounding peripheries of the high frequency signal terminals, and the inner shells, which are disposed on a second symmetry axis, form a linearly symmetrical shape with the second symmetry axis as a center line of the outer shells along a second direction orthogonal to the first direction in which the high frequency signal terminals are arranged, and in a sectional view of each of the high frequency signal terminals along the first direction when viewed from the second direction, the high frequency signal terminals form a linearly symmetrical shape with a first symmetry axis as a center line of the high frequency signal terminals in the first direction orthogonal to the second symmetry axis.

2. The connector assembly according to claim 1, wherein the connector assembly is a board-to-board connector for electrically connecting a first circuit board on which the first connector is mounted and a second circuit board on which the second connector is mounted.

3. A connector which is usable as the first connector according to claim 1.

4. A connector which is usable as the second connector according to claim 1.

5. A connector assembly comprising:

a first connector and a second connector, the first connector being mateable with and removable from the second connector along a first direction, wherein each of the first connector and the second connector includes an outer shell and at least two high frequency signal terminals, the high frequency signal terminals and the outer shells adjacently disposed to the high frequency signal terminals form a quasi-stripline structure, and the high frequency signal terminals and the adjacently disposed outer shells on a second symmetry axis form the quasi-stripline structure having a linearly symmetrical shape with the second symmetry axis as a center line of the outer shells along a direction orthogonal to the first direction in which the high frequency signal terminals are arranged.

6. The connector assembly according to claim 1, wherein each of the first connector and the second connector includes an insulator, the outer shell surrounding the insulator, and the inner shell arranged inside the insulator, the inner shell of the first connector includes two first inner shell portions apart from each other in the second direction, and each of the high frequency signal terminals is arranged between the outer shell of the first connector and each of the two first inner shell portions in the second direction, the inner shell of the second connector includes two second inner shell portions apart from each other in the second direction, and each of the high frequency signal terminals is arranged between the outer shell of the second connector and each of the two second inner shell portions in the second direction, and the high frequency signal terminals of the first connector are engaged to the high frequency signal terminals of the second connector.

7. The connector assembly according to claim 6, wherein each of the high frequency signal terminals arranged between the outer shell of the first connector and each of the two first inner shell portions is disposed on the center line of the outer shell of the first connector along the second direction, and each of the high frequency signal terminals between the outer shell of the second connector and each of the two second inner shell portions is disposed on the center line of the outer shell of the second connector along the second direction.

8. The connector assembly according to claim 7, wherein the high frequency signal terminals, each being arranged between the outer shell of the first connector and each of the two first inner shell portions, form a linearly symmetrical shape with the center line thereof extending in the first direction, when viewed from the second direction, and the high frequency signal terminals, each being arranged between the outer shell of the second connector and each of the two second inner shell portions, form a linearly symmetrical shape with the center line thereof extending in the first direction, when viewed from the second direction.

* * * * *